US009056040B2

(12) United States Patent
Gesell et al.

(10) Patent No.: US 9,056,040 B2
(45) Date of Patent: Jun. 16, 2015

(54) CARDBOARD CREMATION CONTAINERS

(71) Applicant: Batesville Services, Inc., Batesville, IN (US)

(72) Inventors: Justin Michael Gesell, Brookville, IN (US); Robert Lee Olinger, Middletown, OH (US)

(73) Assignee: Batesville Services, Inc., Batesville, IN (US)

( * ) Notice: Subject to any disclaimer, the term of this patent is extended or adjusted under 35 U.S.C. 154(b) by 0 days.

(21) Appl. No.: 13/800,182

(22) Filed: Mar. 13, 2013

(65) Prior Publication Data

US 2014/0026378 A1 Jan. 30, 2014

Related U.S. Application Data

(60) Provisional application No. 61/675,550, filed on Jul. 25, 2012.

(51) Int. Cl.

| | |
|---|---|
| ***A61G 17/007*** | (2006.01) |
| ***B65D 5/64*** | (2006.01) |
| ***A61G 17/02*** | (2006.01) |

(52) U.S. Cl.

CPC ..... *A61G 17/0073* (2013.01); *B65D 5/64* (2013.01); *A61G 17/02* (2013.01)

(58) Field of Classification Search

CPC ..... A61G 17/0073; A61G 17/04; A61G 2017/004; A61G 2017/41; A61G 17/02; B65D 5/22; B65D 5/247; B65D 5/30; B65D 5/46024; B65D 5/56; B65D 5/60; B65D 5/64; B65D 5/46016

USPC ..... 27/2, 4, 14, 19, 27; 229/117.09, 117.19, 229/117.28, 122.34, 125.01, 165, 170–172, 229/190, 192, 117.25; 220/6; 16/424

See application file for complete search history.

(56) References Cited

U.S. PATENT DOCUMENTS

| | | | | |
|---|---|---|---|---|
| D227,247 | S * | 6/1973 | Dittbenner | D99/12 |
| 3,782,619 | A * | 1/1974 | Dittbenner | 206/527 |
| 4,151,630 | A * | 5/1979 | Havey | 27/2 |

(Continued)

OTHER PUBLICATIONS

248507 Trayview 27, 1 page, a product of the assignee's in public use and on sale in the US more than one year prior to Jul. 25, 2012.

(Continued)

*Primary Examiner* — William Miller

(74) *Attorney, Agent, or Firm* — Wood, Herron & Evans, LLP

(57) ABSTRACT

A cardboard cremation container has a cardboard base having a pair of opposed side walls, a pair of opposed end walls, and a bottom wall, and a cardboard lid on the base, the lid having a pair of opposed side walls, an end wall, a header wall, and a top wall. Each of the side walls of the base has a notch formed in an upper edge thereof. The side walls and the end wall of the lid extend outwardly beyond the side walls and one end wall of the base, and lower edges of the side walls and the end wall of the lid are positioned below upper edges of the side walls and the one end wall of the base. The header wall of the lid fits in the notches in the side walls of the base. The lid includes a riser at each corner of the lid formed by each lid side wall and a respective end of the lid end wall. The risers are supported on respective corners of the base formed by each base side wall and a respective end of the one base end wall.

29 Claims, 17 Drawing Sheets

(56) References Cited

U.S. PATENT DOCUMENTS

| | | | | |
|---|---|---|---|---|
| 4,156,956 | A | 6/1979 | Partridge et al. | |
| 4,773,134 | A * | 9/1988 | Kay | 27/14 |
| 4,944,076 | A * | 7/1990 | Kay et al. | 27/14 |
| 5,307,545 | A | 5/1994 | Stoltz | |
| 5,775,061 | A | 7/1998 | Enneking et al. | |
| 5,815,898 | A * | 10/1998 | Jenkins | 27/4 |
| 5,960,978 | A * | 10/1999 | Jenkins | 220/200 |
| 6,105,220 | A | 8/2000 | Belanger | |
| 6,145,175 | A | 11/2000 | Enneking et al. | |
| 6,154,937 | A | 12/2000 | Enneking et al. | |
| 6,694,579 | B2 * | 2/2004 | Belanger et al. | 27/4 |
| 7,003,855 | B2 * | 2/2006 | Lew | 27/4 |
| 7,204,003 | B2 | 4/2007 | Davis et al. | |
| 7,213,311 | B2 | 5/2007 | Davis et al. | |
| 7,234,211 | B2 | 6/2007 | Davis et al. | |
| 7,249,402 | B2 | 7/2007 | Davis et al. | |
| 7,249,403 | B2 | 7/2007 | Davis et al. | |
| 7,263,751 | B2 | 9/2007 | Davis et al. | |
| 7,322,079 | B2 | 1/2008 | Davis et al. | |
| 7,350,278 | B2 | 4/2008 | Davis et al. | |
| 7,774,907 | B2 * | 8/2010 | Rosato et al. | 27/4 |
| 8,104,151 | B2 | 1/2012 | Cox et al. | |
| 8,347,467 | B2 | 1/2013 | Davis et al. | |
| 8,356,392 | B2 | 1/2013 | Jackson | |
| 8,375,535 | B2 | 2/2013 | Cox et al. | |
| 8,595,908 | B2 * | 12/2013 | Cox et al. | 27/4 |
| 2005/0193535 | A1 | 9/2005 | Davis et al. | |
| 2007/0084028 | A1 | 4/2007 | Cox et al. | |
| 2014/0123450 | A1 * | 5/2014 | Jenson | 27/14 |
| 2014/0259577 | A1 * | 9/2014 | Richardson | 27/28 |

OTHER PUBLICATIONS

242414 Trayview 25, 1 page, a product of the assignee's in public use and on sale in the US more than one year prior to Jul. 25, 2012.

Options image Trayview 29, 1 page, a product of the assignee's in public use and on sale in the US more than one year prior to Jul. 25, 2012.

100011 Minimum Cardboard, 1 page, a product of the assignee's in public use and on sale in the US more than one year prior to Jul. 25, 2012.

* cited by examiner

CARDBOARD CREMATION CONTAINERS

RELATED APPLICATIONS

This application claims the priority benefit of U.S. Provisional Patent Application No. 61/675,550 filed Jun. 25, 2012, which is hereby incorporated by reference herein as if fully set forth in its entirety.

FIELD OF THE INVENTION

This invention relates generally to caskets, and more particularly to corrugated cremation containers.

BACKGROUND OF THE INVENTION

Traditional caskets have historically been employed for both in-ground burial and above-ground interment. Traditional caskets are typically fabricated from fine furniture-grade wood or from highly polished/finished sheet metal, for aesthetic reasons.

While traditional in-ground burial and above-ground interment in a traditional casket continue to be the method of choice for the ultimate disposition of the remains of the deceased for a majority of funeral customers, cremation nevertheless continues to be a growing segment of the death care industry. Cremation caskets are typically fabricated of corrugated fiberboard, sometimes referred to as cardboard, of hardboard, or of plywood, due to the combustibility and low cost of these materials. Of these materials, cardboard generally tends to be the least expensive, and accordingly a significant percentage of cremation caskets are fabricated from cardboard.

Briefly, corrugated board or cardboard is made from papers made up of cellulose fibers, either virgin or recycled. Two sheets of paper, called liners, are glued to opposite surfaces of a corrugated inner medium, called the fluting. These three layers of paper, assembled in this way, form a series of connected arches that provide a structure having overall better strength/stiffness characteristics than that of each individual layer.

Cardboard cremation caskets present significant design challenges. Both traditional caskets and cremation caskets include a lower body containing portion known as a shell or base, and an upper portion known as a cap or lid closeable on the lower portion. One particularly compelling challenge in designing cardboard cremation caskets is how to achieve the required stiffness of the shell portion of the cardboard casket so that the cardboard casket will not twist, deflect, or otherwise have its shape distorted under the load of the deceased. Another compelling design challenge for designers of cardboard cremation caskets is aesthetics—how to present the cardboard cremation casket in the most aesthetically pleasing manner.

While advances have been made in the design of cardboard cremation caskets, there nevertheless continues to be room for improvement in this area.

SUMMARY OF THE INVENTION

In one aspect, a cardboard cremation container is provided. The container has a cardboard base having a pair of opposed side walls, a pair of opposed end walls, and a bottom wall, and a cardboard lid on the base, the lid having a pair of opposed side walls, an end wall, a header wall, and a top wall. Each of the side walls of the base has a notch formed in an upper edge thereof. The side walls and the end wall of the lid extend outwardly beyond the side walls and one end wall of the base, and lower edges of the side walls and the end wall of the lid are positioned below upper edges of the side walls and the one end wall of the base. The header wall of the lid fits in the notches in the side walls of the base. The lid includes a riser at each corner of the lid formed by each lid side wall and a respective end of the lid end wall. The risers are supported on respective corners of the base formed by each base side wall and a respective end of the one base end wall.

The notches have a depth dimension, and the lower edges of the risers are positioned above lower edges of the lid side walls and end wall by a height dimension. The depth dimension and the height dimension are preferably about equal. The notches have a width dimension measured in a direction generally parallel to the side walls of the base. The width dimension is preferably about equal to twice the thickness of the header wall of the lid. The container can have a second lid. The side walls and the end wall of the second lid extend outwardly beyond the side walls and the other end wall of the base, and lower edges of the side walls and the end wall of the second lid are positioned below upper edges of the side walls and the other end wall of the base. The header walls of the lids fit snugly in the notches in the side walls of the base. The risers of the second lid are supported on respective corners of the base formed by each base side wall and a respective end of the other base end wall.

In one embodiment, the side walls and the end wall of the lid are generally vertically oriented and connected directly to the top wall of the lid. In another embodiment, the side walls and the end wall of the lid are generally vertically oriented and are connected indirectly to the top wall of the lid with planar lid portions that slope outwardly and downwardly from the top wall to the lid side walls and lid end wall. In either embodiment, the side walls and the end walls of the base preferably slope inwardly and downwardly from the upper edges of the side walls and the end walls to the bottom wall.

The side walls and the end walls of the base can include a plurality of hand hold cut-outs, each of the cut-outs defined by an upper horizontal score line, a lower horizontal cut line, and end semi-circular cut lines. Alternatively, the container can have a pair of longitudinal carrying straps and a pair of transverse carrying straps. Either way, the container can have an outer base and an inner base disposed in the outer base, the inner base also having a pair of opposed side walls, a pair of opposed end walls, and a bottom wall.

In another aspect, another cardboard cremation container is provided. The container has a cardboard base having a pair of opposed side walls, a pair of opposed end walls, and a bottom wall, and a cardboard lid on the base, the lid having a pair of opposed side walls, an end wall, a header wall, and a top wall. The container also has a pair of longitudinal carrying straps, and a pair of transverse carrying straps. Each of the pair of longitudinal carrying straps has a loop on one end, passes through an opening in one of the end walls of the base, extends under an upper surface of the bottom wall of the base, passes through an opening in the other end wall of the base, and has a loop on the other end. Each of the pair of transverse carrying straps has a loop on one end, passes through an opening in one of the side walls of the base, extends under the upper surface of the bottom wall of the base, passes through an opening in the other side wall of the base, and has a loop on the other end.

The container can have an outer base and an inner base disposed in the outer base, the inner base having a pair of opposed side walls, a pair of opposed end walls, and a bottom wall. Each of the pair of longitudinal carrying straps passes through an opening in one of the end walls of the inner base, extends under the bottom wall of the inner base, and passes through an opening in the other end wall of the inner base. Each of the pair of transverse carrying straps passes through an opening in one of the side walls of the inner base, extends under the bottom wall of the inner base, and passes through an opening in the other side wall of the inner base.

In other aspects, cardboard blanks from which to fold cremation container bases and lids are provided, as are cremation container bases and lids folded from the cardboard blanks.

A cardboard blank for a lid for a cardboard cremation container is provided. The blank has a top wall panel, a side wall panel foldably connected to each opposite side of the top wall panel, a side wall roll over panel foldably connected to each side wall panel, a riser tab foldably connected to an end of each side wall roll over panel, an end wall panel foldably connected to one end of the top wall panel, a flap foldably connected to each opposite end of the end wall panel, and a header wall panel foldably connected to the other end of the top wall panel, a flap foldably connected to each opposite end of the header wall panel.

Each riser tab has a first free edge opposite a fold line foldably connecting the riser tab to a respective side wall roll over panel. The riser tab fold line is positioned inward of an adjacent end of the side wall panel. The riser tab first free edge is positioned outward of the adjacent end of the side wall panel. Each riser tab also has a second free edge adjacent the fold line foldably connecting the riser tab to a respective side wall roll over panel. The riser tab second free edge is positioned outward of a fold line foldably connecting the side wall roll over panel to the side wall panel. A free edge of the header wall panel can be inwardly curved.

A cardboard lid for a cardboard cremation container is provided. The lid has a top wall panel, a side wall panel foldably connected to each opposite side of the top wall panel, a side wall roll over panel foldably connected to each side wall panel, a riser tab foldably connected to an end of each side wall roll over panel, an end wall panel foldably connected to one end of the top wall panel, a flap foldably connected to each opposite end of the end wall panel, and a header wall panel foldably connected to the other end of the top wall panel, a flap foldably connected to each opposite end of the header wall panel. The side wall panels, end wall panel, and header wall panel are folded relative to the top wall panel to form a pair of opposed side walls, an end wall, a header wall, and a top wall of the lid, with the flaps on the end wall panel and on the header wall panel folded so as to be positioned inward of the side wall panels. The side wall roll over panels are folded relative to the side wall panels so as to be positioned inward of the side wall panels and the flaps. The riser tabs are folded so as to angle across a respective corner of the lid formed by each lid side wall and a respective end of the lid end wall.

The lower edges of the risers are positioned above lower edges of the lid side walls and end wall. A free edge of the header wall can be upwardly curved.

Another cardboard blank for a lid for a cardboard cremation container is provided. The blank has a top wall panel, a side rim wall panel foldably connected to each opposite side of the top wall panel, a side wall panel foldably connected to each side rim wall panel, a side wall roll over panel foldably connected to each side wall panel, a riser tab foldably connected to an end of each side wall roll over panel, an end rim wall panel foldably connected to one end of the top wall panel, an end wall panel foldably connected to the end rim wall panel, an end wall roll over panel foldably connected to the end wall panel, a flap foldably connected to each opposite end of the end wall roll over panel, and a header wall panel foldably connected to the other end of the top wall panel, a flap foldably connected to each opposite end of the header wall panel.

Each riser tab has a first free edge opposite a fold line foldably connecting the riser tab to a respective side wall roll over panel. The riser tab fold line is positioned inward of an adjacent end of the side wall panel. The riser tab first free edge is positioned outward of the adjacent end of the side wall panel. Each riser tab also has a second free edge adjacent the fold line foldably connecting the riser tab to a respective side wall roll over panel. The riser tab second free edge is positioned outward of a fold line foldably connecting the side wall roll over panel to the side wall panel. A free edge of the header wall panel can be inwardly curved.

Another cardboard lid for a cardboard cremation container is provided. The lid has a top wall panel, a side rim wall panel foldably connected to each opposite side of the top wall panel, a side wall panel foldably connected to each side rim wall panel, a side wall roll over panel foldably connected to each side wall panel, a riser tab foldably connected to an end of each side wall roll over panel, an end rim wall panel foldably connected to one end of the top wall panel, an end wall panel foldably connected to the end rim wall panel, an end wall roll over panel foldably connected to the end wall panel, a flap foldably connected to each opposite end of the end wall roll over panel, and a header wall panel foldably connected to the other end of the top wall panel, a flap foldably connected to each opposite end of the header wall panel. The side rim wall panels, side wall panels, end rim wall panel, end wall panel, and header wall panel are folded relative to the top wall panel to form a pair of opposed side rim walls, a pair of opposed side walls, an end rim wall, an end wall, a header wall, and a top wall of the lid, with the flaps on the end wall roll over panel and on the header wall panel folded so as to be positioned inward of the side wall panels. The side wall roll over panels are folded relative to the side wall panels so as to be positioned inward of the side wall panels and the flaps. The riser tabs are folded so as to angle across a respective corner of the lid formed by each lid side wall and a respective end of the lid end wall.

The lower edges of the risers are positioned above lower edges of the lid side walls and end wall. A free edge of the header wall can be upwardly curved.

A cardboard base for a cardboard cremation is provided. The base comprises cardboard outer base and a card board inner base. The outer base comprises a bottom wall panel, a side wall panel foldably connected to each opposite side of the bottom wall panel, a flap foldably connected to each opposite end of each side wall panel, a side wall roll over panel foldably connected to each side wall panel, an end wall panel foldably connected to each opposite end of the bottom wall panel, and an end wall roll over panel foldably connected to each end wall panel. The inner base comprises a bottom wall panel, a side wall panel foldably connected to each opposite side of the bottom wall panel, and an end wall panel foldably connected to each opposite end of the bottom wall panel. The side wall panels and end wall panels of the outer base are folded relative to the bottom wall panel of the outer base to form a pair of opposed outer side walls, a pair of opposed outer end walls, and an outer bottom wall of the base, with the flaps on the side wall panels of the outer base folded so as to be positioned inward of the end wall panels of the outer base. The end wall roll over panels of the outer base are folded relative to the end wall panels so as to be positioned inward of the end wall panels and the flaps. The side wall panels and end wall panels of the inner base are folded relative to the bottom wall panel of the inner base to form a pair of opposed inner side walls, a pair of opposed inner end walls, and an inner bottom wall of the base. The inner base is placed into the outer base. The side wall roll over panels of the outer base are folded relative to the side wall panels of the outer base so as to be positioned inward of the side walls of the inner base.

The height of the various panels can be variously dimensioned. For example, the height of the side wall panels of the inner base can be about equal to the height of the side wall panels of the outer base, the height of the side wall roll over panels of the outer base can be less than the height of the side wall panels of the outer base, and the height of the end wall roll over panels of the outer base can be less than the height of the end wall panels of the outer base. As another example, the height of the side wall roll over panels of the outer base can be about equal to the height of the end wall roll over panels of the outer base. And, the outer side walls and the outer end walls of the outer base can slope inwardly and downwardly from upper edges of the outer side walls and the outer end walls to the outer bottom wall.

The accompanying drawings, which are incorporated in and constitute a part of this specification, illustrate embodiments of the invention and, together with the summary of the invention given above, and the detailed description of the drawings given below, serve to explain the principles of the present invention.

DETAILED DESCRIPTION OF THE DRAWINGS

Figure 1:
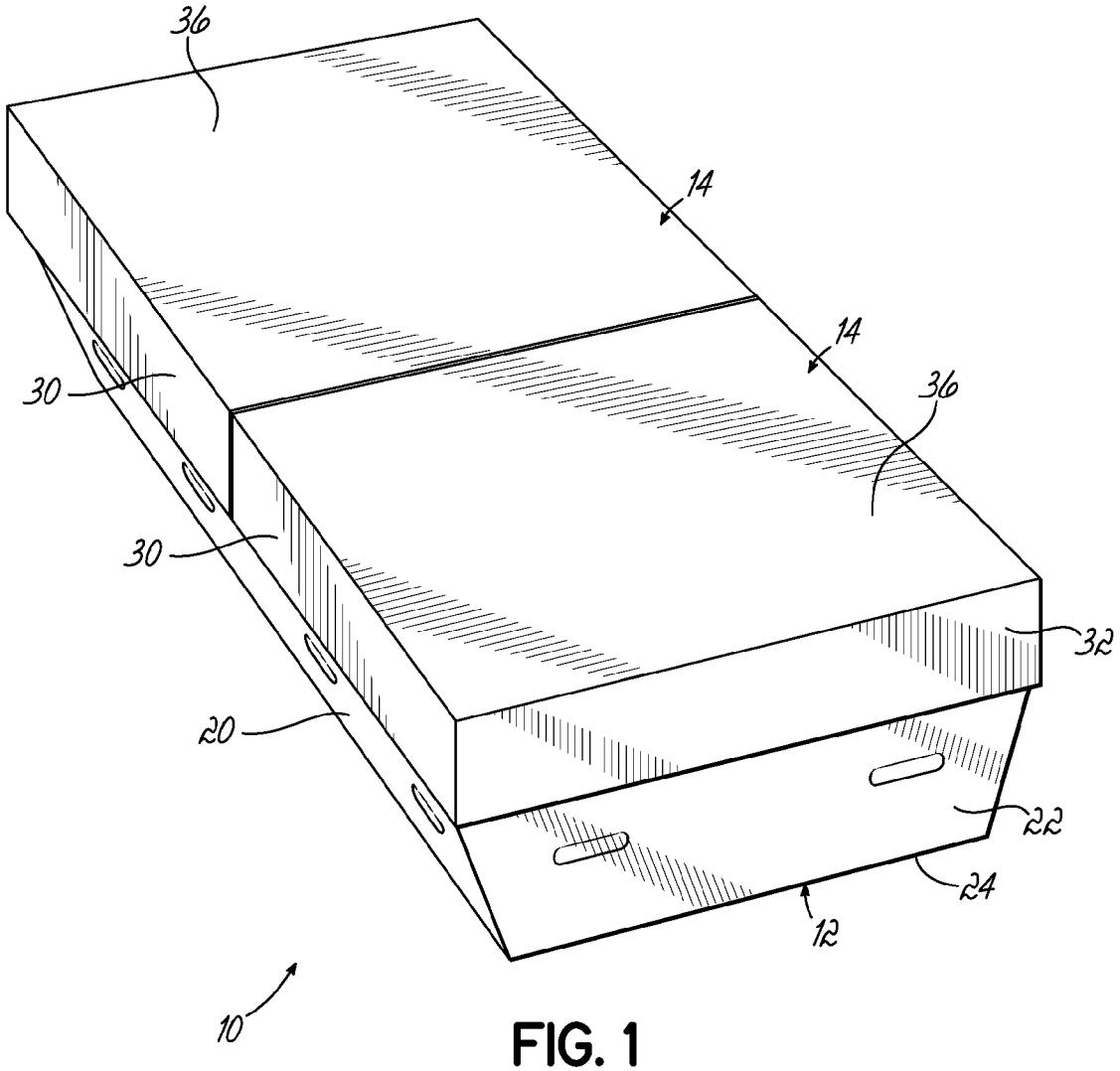
FIG. 1 is a perspective view of a cardboard cremation container according to the principles of the present invention.
Figure 2A:
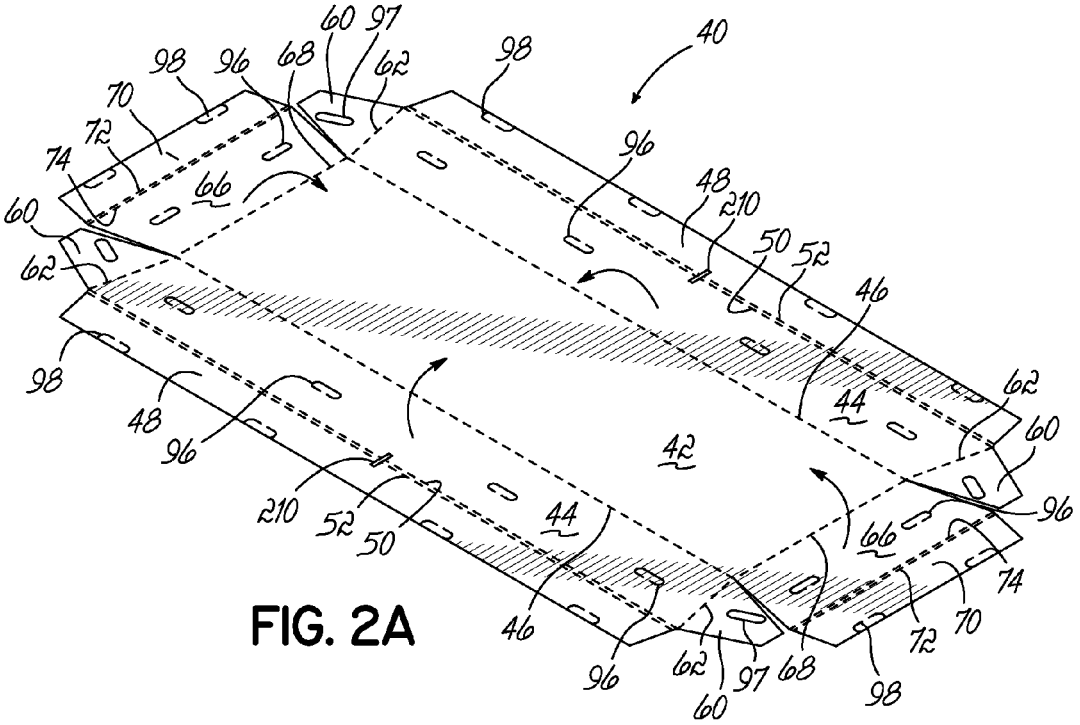
FIGS. 2A-2D illustrate steps in folding the base blank into the base of the container of FIG. 1.
Figure 2B:
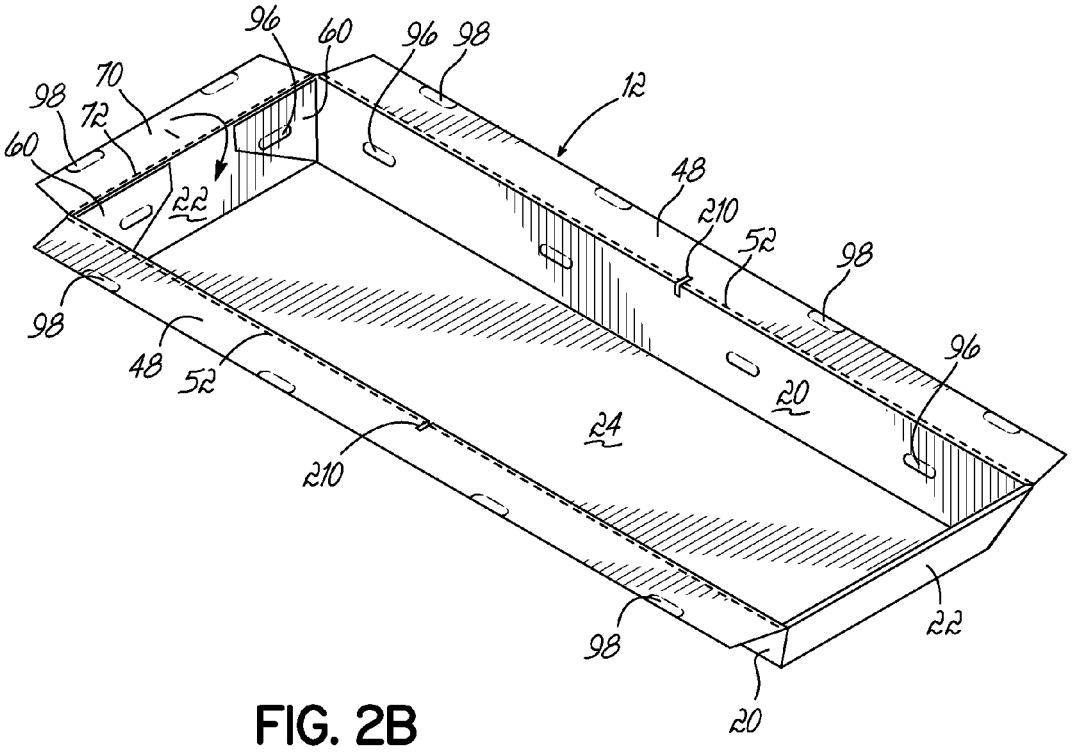
Figure 2C:
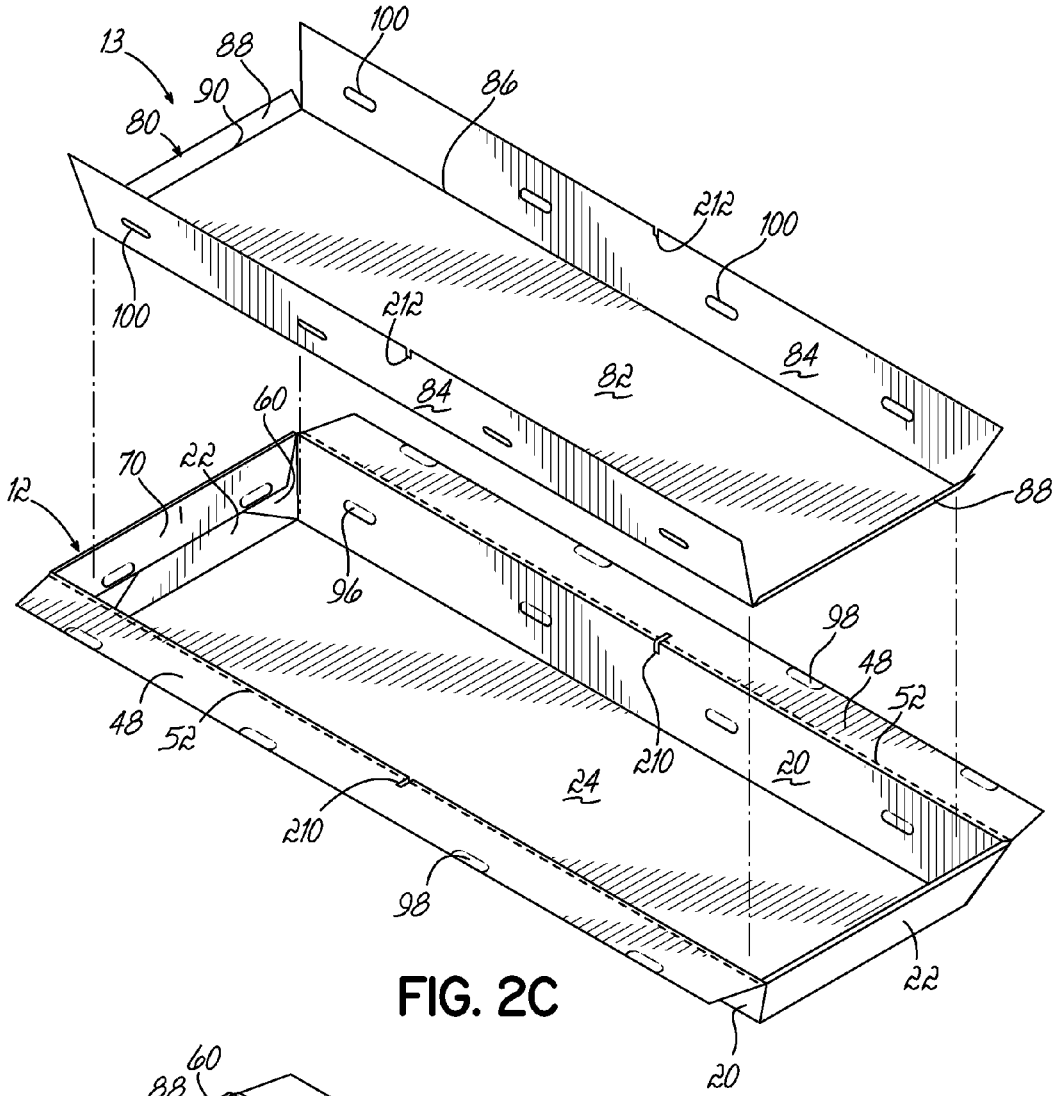
Figure 2D:
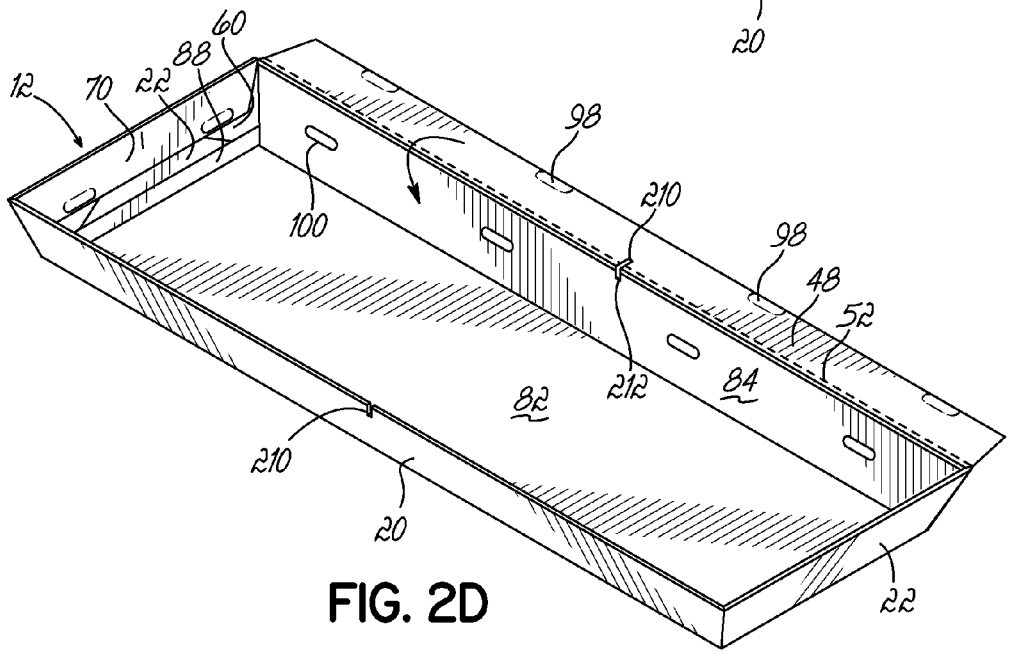

Referring first to FIG. 1, a cardboard cremation container 10 according to the principles of the present invention is illustrated. The container 10 has a base 12 and a pair of identical lids 14, 14 closeable on the base 12. The base 12 has a pair of opposed side walls 20, 20, a pair of opposed end walls 22, 22, and a bottom wall 24. Each lid 14 has a pair of opposed side walls 30, 30, an end wall 32, a header wall 34 (FIG. 6), and a top wall 36.

Referring to FIGS. 2A-2D, a blank 40 from which to erect the base 12 is illustrated. Blank 40 has a bottom wall panel 42, a side wall panel 44 foldably connected to each opposite side of the bottom wall panel 42 via a score line or crease line or fold line 46, and a side wall roll over panel 48 foldably connected to each side wall panel 44 via a pair of closely spaced score lines or crease lines or fold lines 50, 52. (As used herein, the term "score line" shall be deemed to embrace a fold line whether that fold line is actually scored or not, and shall also be deemed to embrace the term "crease line." In other words, the terms "score line," "crease line," and "fold line" are used interchangeably herein.) Closely spaced score lines 50, 52 form a roll over edge therebetween. A flap 60 is foldably connected to each opposite end of each side wall panel 44 via a score line 62. Blank 40 has an end wall panel 66 foldably connected to each opposite end of the bottom wall panel 42 via a score line 68, and an end wall roll over panel 70 foldably connected to each end wall panel 66 via a pair of closely spaced score lines 72, 74. Closely spaced score lines 72, 74 form a roll over edge therebetween.

An inner base 13 is erected from a blank 80. Blank 80 likewise has a bottom wall panel 82, a full height side wall panel 84 foldably connected to each opposite side of the bottom wall panel 82 via a score line 86, and a shorter end wall panel 88 foldably connected to each opposite end of the bottom wall panel 82 via a score line 90.

To erect base 12 from blank 40, side wall panels 44 are folded upwardly and flaps 60 are folded inwardly. End wall panels 66 are folded upwardly. Flaps 60 are secured to end wall panels 66 with hot melt glue. End wall roll over panels 70 are folded inwardly and secured to flaps 60 and/or end wall panels 66 with hot melt glue. Inner base 13 is placed in outer base 12, and side wall roll over panels 48 are folded inwardly onto side wall panels 82 of inner base 13 and secured with hot melt glue.

Side wall panels 44 and end wall panels 66 of blank 40 include a plurality of hand hold cut-outs 96, each cut-out defined by an upper horizontal score line, a lower horizontal cut line, and end semi-circular cut lines. Similar hand hold cut-outs 98 are provided in side wall roll over panels 48 and end wall roll over panels 70 so as to not interfere with hand holds 96. Clearance holes 97 are provided in flaps 60 of outer base blank 40 so as to not interfere with hand holds 96 in end wall panels 66. Clearance holes 100 are provided in side wall panels 84 of inner base blank 80 so as to not interfere with hand holds 96.

Figure 3A:
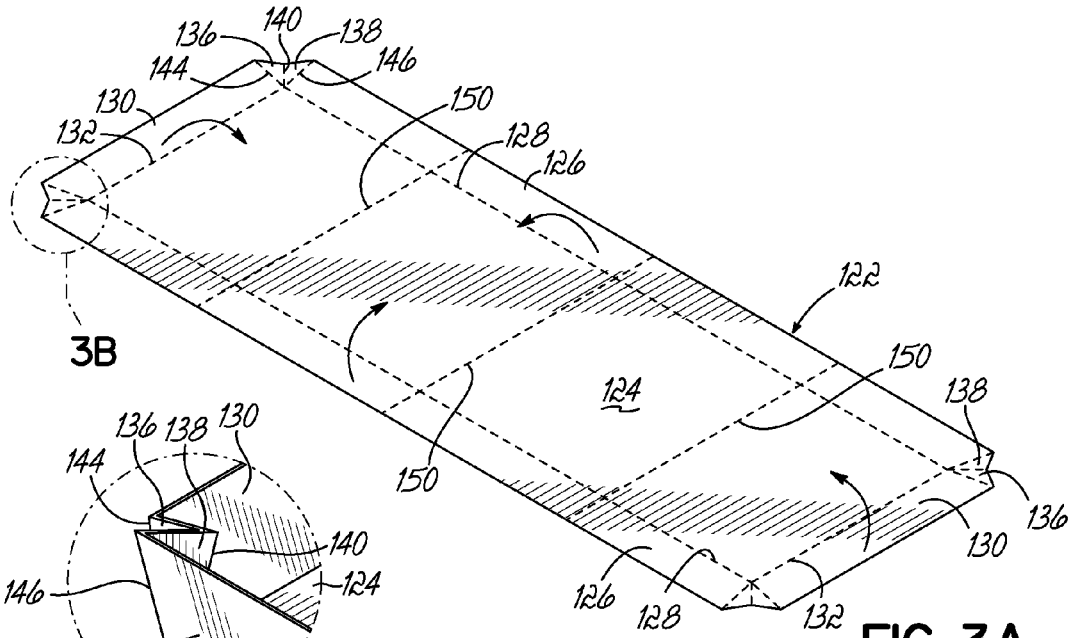
FIG. 3A-3C illustrate steps in folding the leak tray blank into the leak tray of the container of FIG. 1.
Figure 3B:
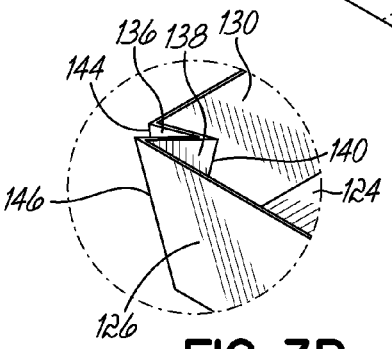
Figure 3C:
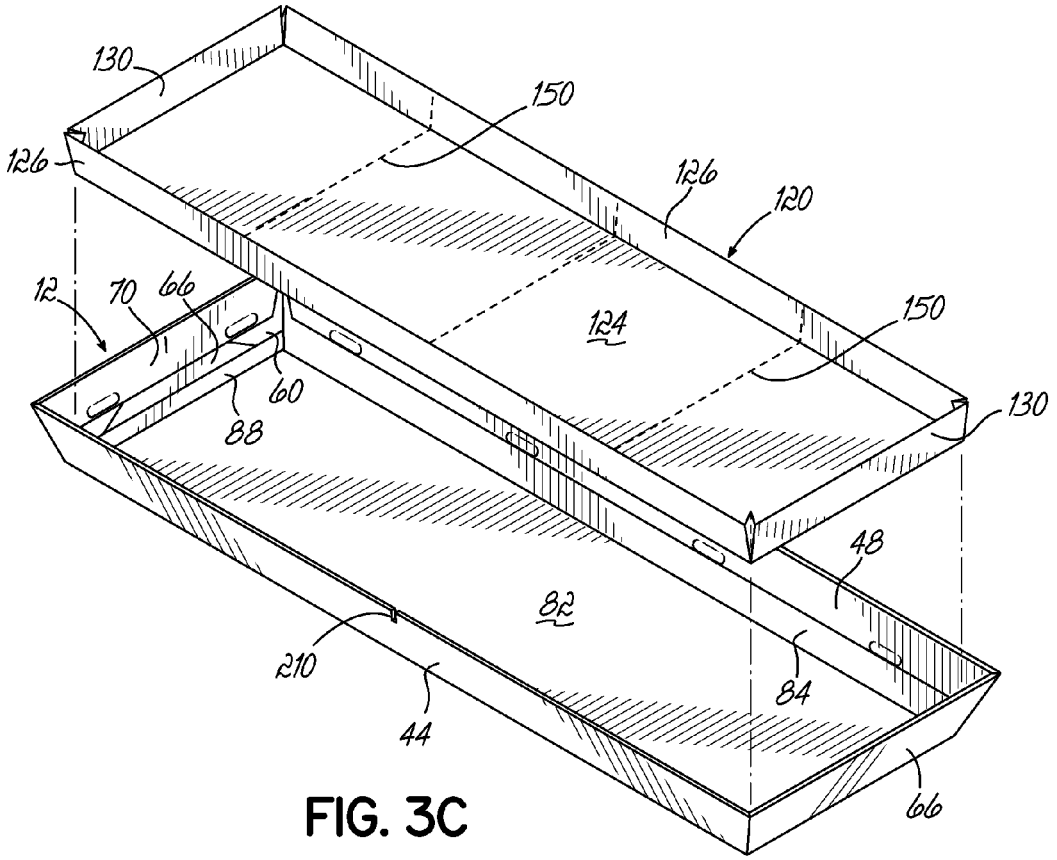

Referring to FIGS. 3A-3C, a drip tray 120 for use with container 10 is illustrated. Drip tray 120 is erected from a blank 122 having a bottom wall panel 124, a side wall panel 126 foldably connected to each opposite side of the bottom wall panel 124 via a score line 128, and an end wall panel 130 foldably connected to each opposite end of the bottom wall panel 124 via a score line 132. Corners of the tray 120 are formed by triangular pleats or gussets 136, 138 foldably connected to one another via score line 140. Pleat or gusset 136 is foldably connected to end wall panel 130 via a score line 144, and pleat or gusset 138 is foldably connected to side wall panel 126 via a score line 146. Tray 120 is preferably coated with a liquid impervious coating such as that available from Michelman, Inc. of Cincinnati, Ohio, www.michelman-.com. Blank 122 also includes a number of transverse score lines 150 permitting the blank 122 to be folded for shipment, as will be subsequently described.

To erect tray 120 from blank 122, side wall panels 126 and end wall panels 130 are folded upwardly, and pleats or gussets 136, 138 are folded inwardly. Tray 120 may then be placed in base 12. Note that the height of the side wall panels 44 and side wall roll over panels 48 and end wall panels 66 and end wall roll over panels 70 of base blank 40 and the height of the side wall panels 126 and end wall panels 130 of drip tray blank 122 are chosen such that the free edges of the side wall panels 126 and end wall panels 130 of drip tray blank 122 will securely "snap in" below the free edges of the side wall roll over panels 48 and end wall roll over panels 70 of base blank 40.

Figure 4A:
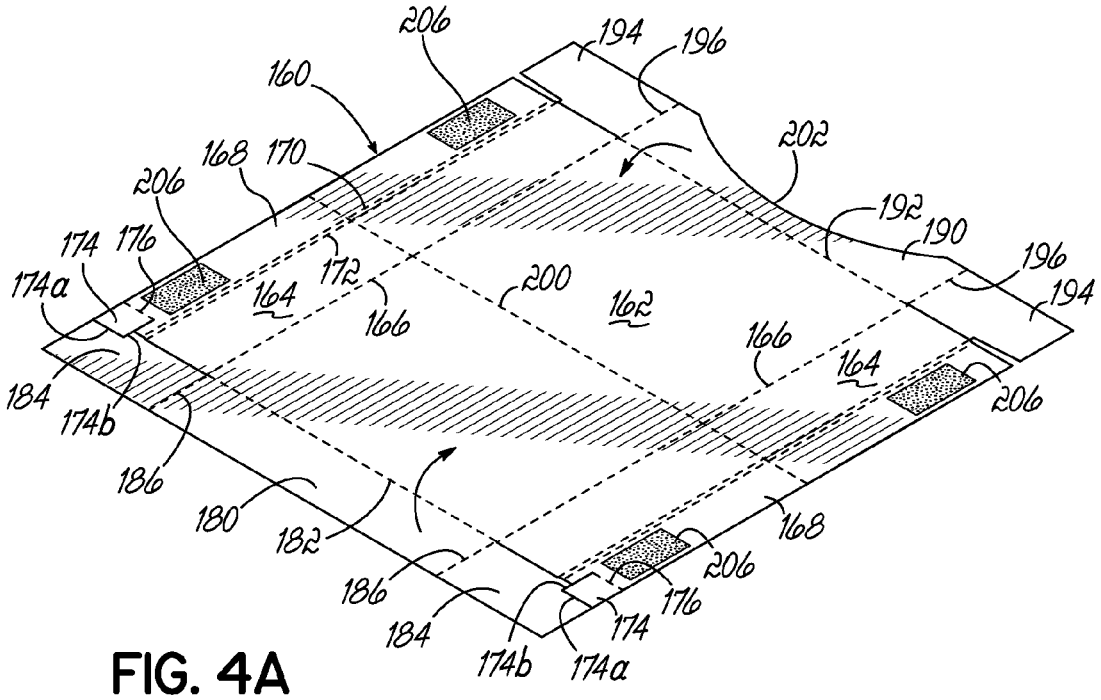
FIGS. 4A and 4B illustrate steps in folding the lid blank into the lid of the container of FIG. 1.
Figure 4B:
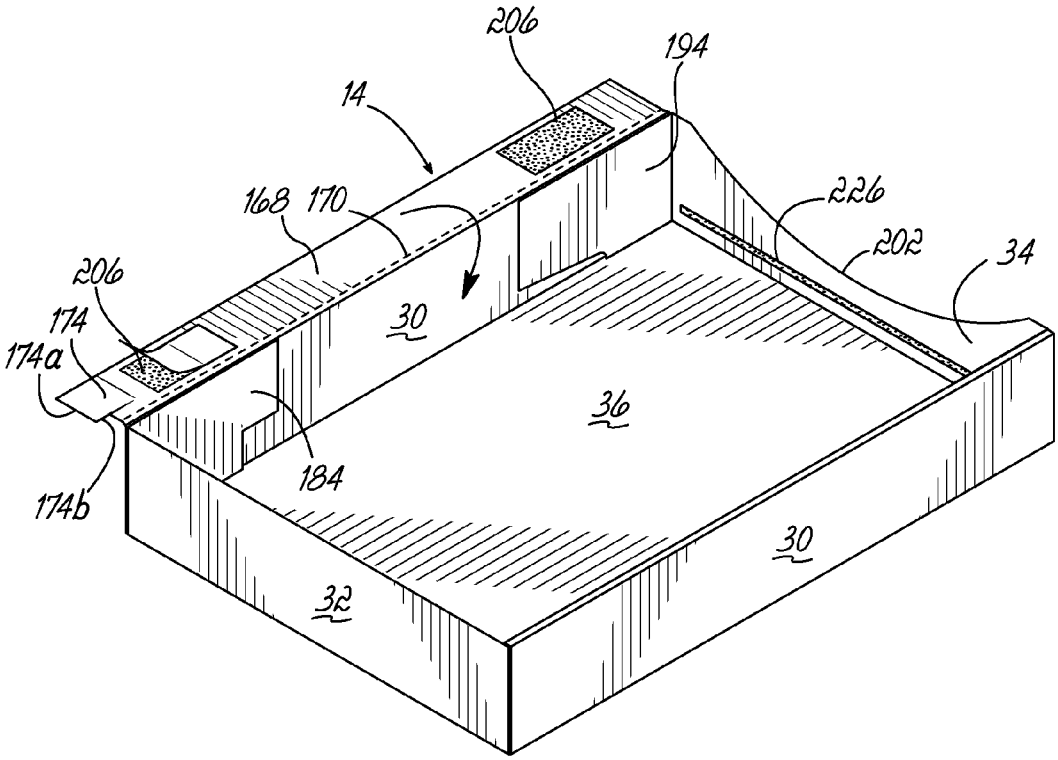

Referring to FIGS. 4A and 4B, a blank 160 from which to erect lid 14 is illustrated. Blank 160 has a top wall panel 162, a side wall panel 164 foldably connected to each opposite side of the top wall panel 162 via a score line 166, and a side wall roll over panel 168 foldably connected to each side wall panel 164 via a pair of closely spaced score lines 170, 172. Closely spaced score lines 170, 172 form a roll over edge therebetween. A riser tab 174 is foldably connected to one end of each side wall roll over panel 168 via a score line 176. Each riser tab 174 has a first free edge 174*a* opposite its score line 176 and a second free edge 174*b* adjacent its score line 176. The riser tab score line 176 is positioned inward of the adjacent end of the side wall panel 164, the riser tab first free edge 174*a* is positioned outward of the adjacent end of the side wall panel 164, and the riser tab second free edge 174*b* is positioned outward of the score lines 170, 172 foldably connecting the side wall roll over panel 168 to the side wall panel 164. Blank 160 has an end wall panel 180 foldably connected to one end of the top wall panel 162 via a score line 182. A flap 184 is foldably connected to each opposite end of the end wall panel 180 via a score line 186. Blank 160 has a header wall panel 190 foldably connected to the opposite end of top wall panel 162 via a score line 192. Header wall panel 190 has a flap 194 foldably connected to each opposite end of the header wall panel 190 via a score line 196. A transverse score line 200 permits the blank 160 to be folded for shipment, as will be subsequently described. The free edge 202 of header wall panel 190 is preferably inwardly curved to accommodate larger bodies.

To assemble the lid 14 from the blank 160, the end wall panel 180 and header wall panel 190 are folded upwardly and flaps 184 and 194 are folded inwardly. Side wall roll over panels 168 are folded inwardly against flaps 184, 194 and side wall panels 164, which causes riser tabs 174 to "pop out" and extend across the corners of lid 14. The side wall panels 164 are secured with double sided tape 206.

Referring back to FIGS. 2A-2D, it will be seen that base blank 40 includes a notch 210 formed in each side wall panel 44, side wall roll over panel 48, and the roll over edge therebetween. A complimentary aligned notch 212 is formed in the free edge of each side wall panel 84 of blank 80 used to erect inner base 13. Once outer base 12 and inner base 13 are assembled as described above, notches 210, 212 provide a means of retaining lids 14 securely on base 12. More particularly, the outer free edges of the header wall 34 of each lid fit into the notches 210, 212 on either side of the base 12. Preferably, the notches 210, 212 have a width dimension that is just about equal to the combined thickness of the header walls 34 of the two lids 14 so as to snugly and securely retain the free edges of the header walls 34 in the notches 210, 212. The notches 210, 212 maintain the header walls 34 in abutting relation, so as to not let the lids 14 slip off either end of the base 12 or allow visibility into the container 10, as well as keep the lids 14 in place even if the container 10 twists or contorts during handling and transport.

When lids 14 are placed on base 12, the lower edges of the side walls 30, 30 and end wall 32 of each lid 14 extend outwardly beyond and downwardly below the upper edges of the side walls 20, 20 and end wall 22 of the base 12. Thus, the lids 14 will lower downwardly until the riser tabs 174 contact and thus are supported by the corners of the base 12. Preferably, the depth of the notches 210, 212 is about the same as the amount by which the lower edges of the riser tabs 174 are positioned above the lower edges of the side walls 30, 30 and end wall 32 of the lid 14. This will cause the lids 14, 14 to be supported on the base 12 substantially horizontally. See FIG. 6. The above described geometry of riser tabs 174 determines the amount by which the lower edges of the riser tabs 174 are positioned above the lower edges of the side walls 30, and end wall 32 of the lid 14.

Figure 5:
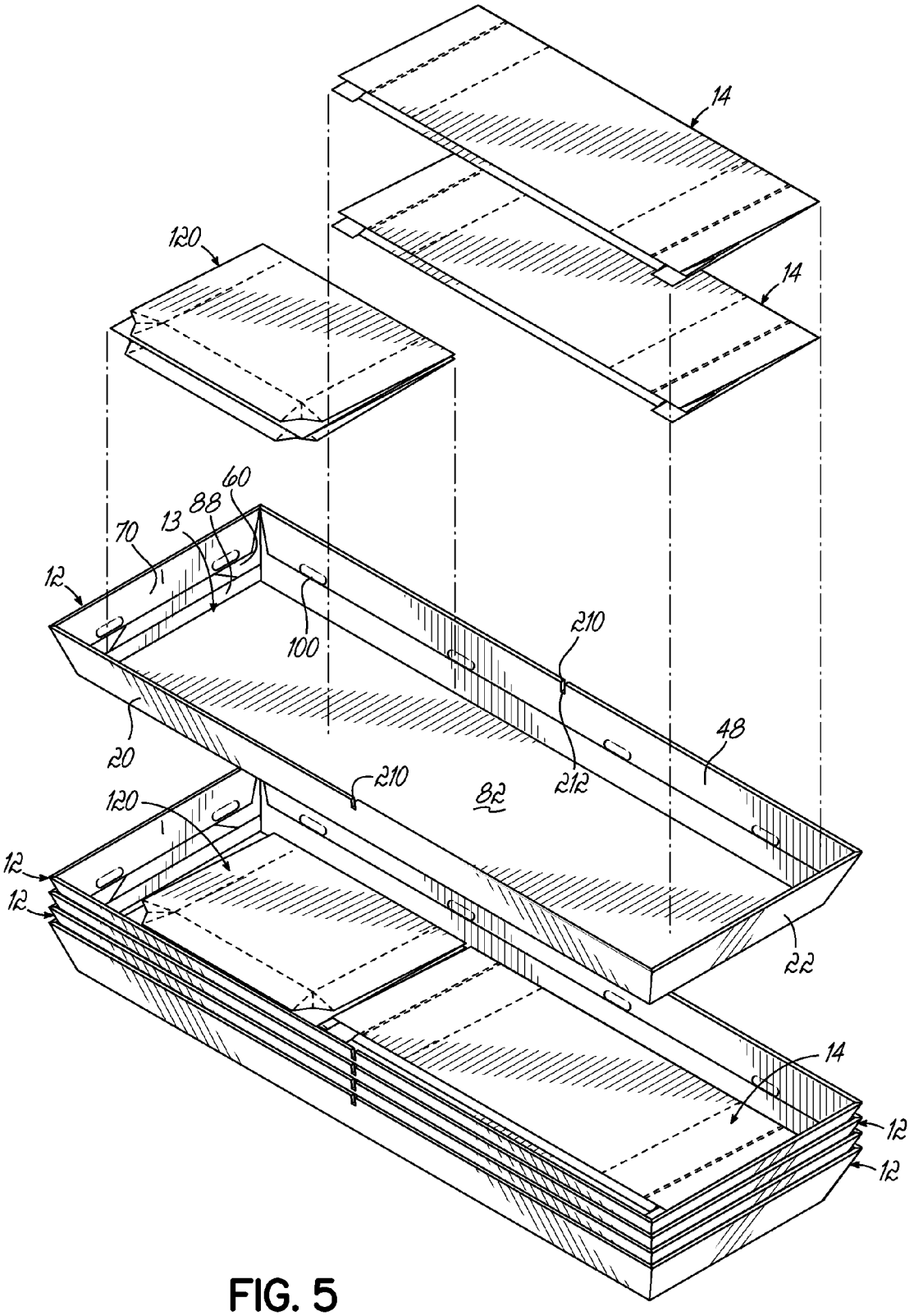
FIG. 5 illustrates a plurality of containers of FIG. 1 configured for shipping.

Referring to FIG. 5, a plurality of containers 10 are illustrated ready for shipment. The geometry of various ones of the panels, flaps, and score lines of the blank 40 described above is selected so as to provide side walls 20 and end walls 22 of base 12 which taper inwardly, by, for example, about 12.75 degrees, and to provide a depth of about 9.5 inches. This permits five bases 12 to be nested for shipment as illustrated, with each base containing therein its two unerected (i.e. flat) lids 14 folded in half and its unerected (i.e. flat) drip tray 120 folded in half and then folded in half again. The entire contents can be shipped in a standard cardboard shipping box measuring about 82.5 inches long by about 29 inches wide by about 20.75 inches deep. At the shipping destination, only the lids 14 need be assembled and drip tray 120 folded and placed into base 12.

Figure 6:
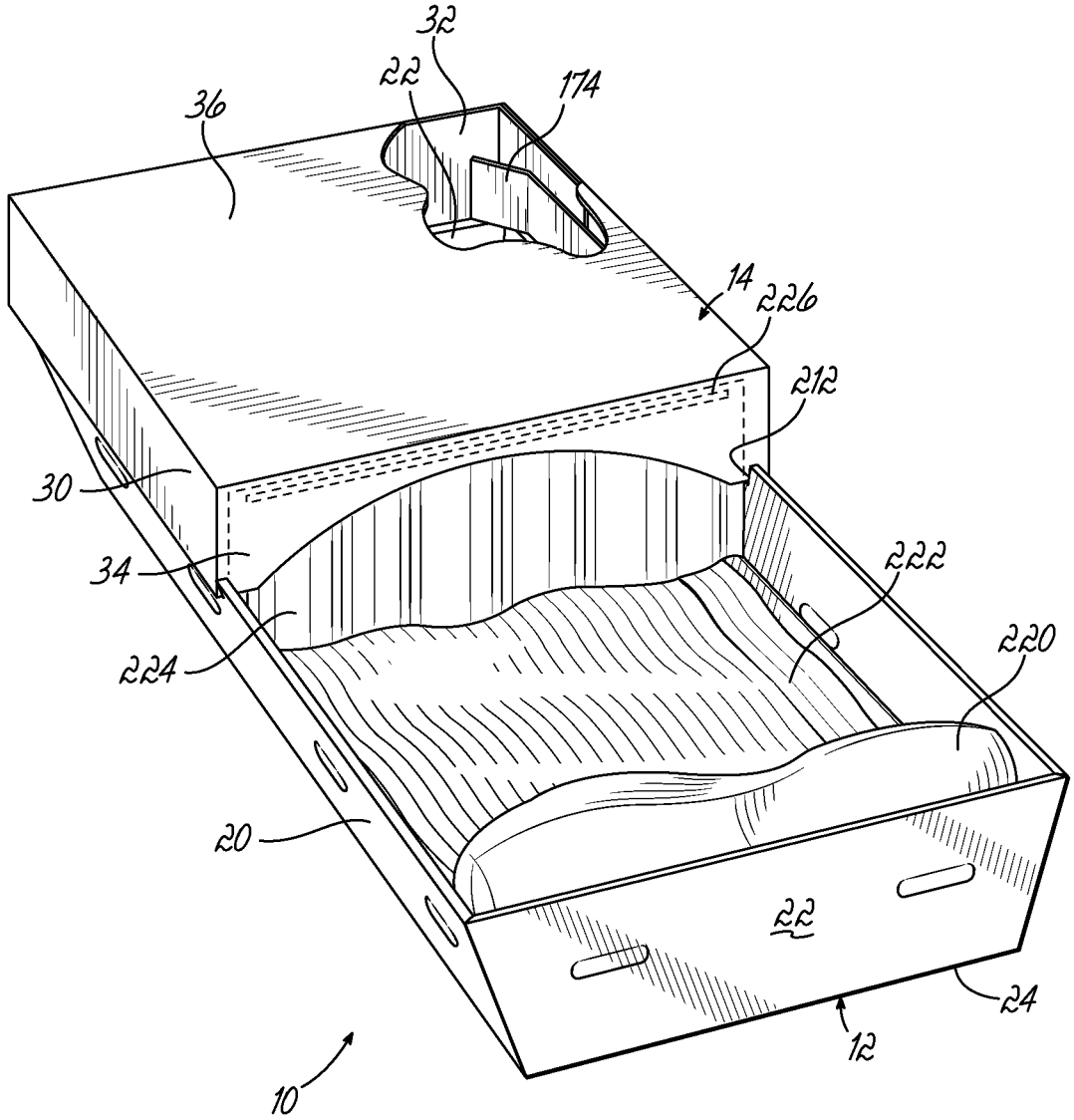
FIG. 6 is a view similar to FIG. 1 with the head end lid removed from the base.

Referring to FIG. 6, to trim the container 10 a pillow 220, a mattress 222, and a header skirt 224 are provided. Header skirt 224 is attached to the inner surface of header wall 34 with double sided tape 226. Double sided tape 226 can be pre-applied to either the header skirt 224 or to the inner surface of header wall 34 (FIG. 4B). Five sets of trim components can be placed in the top base 12 of the five nested bases 12 discussed above, for shipment.

Figure 7:
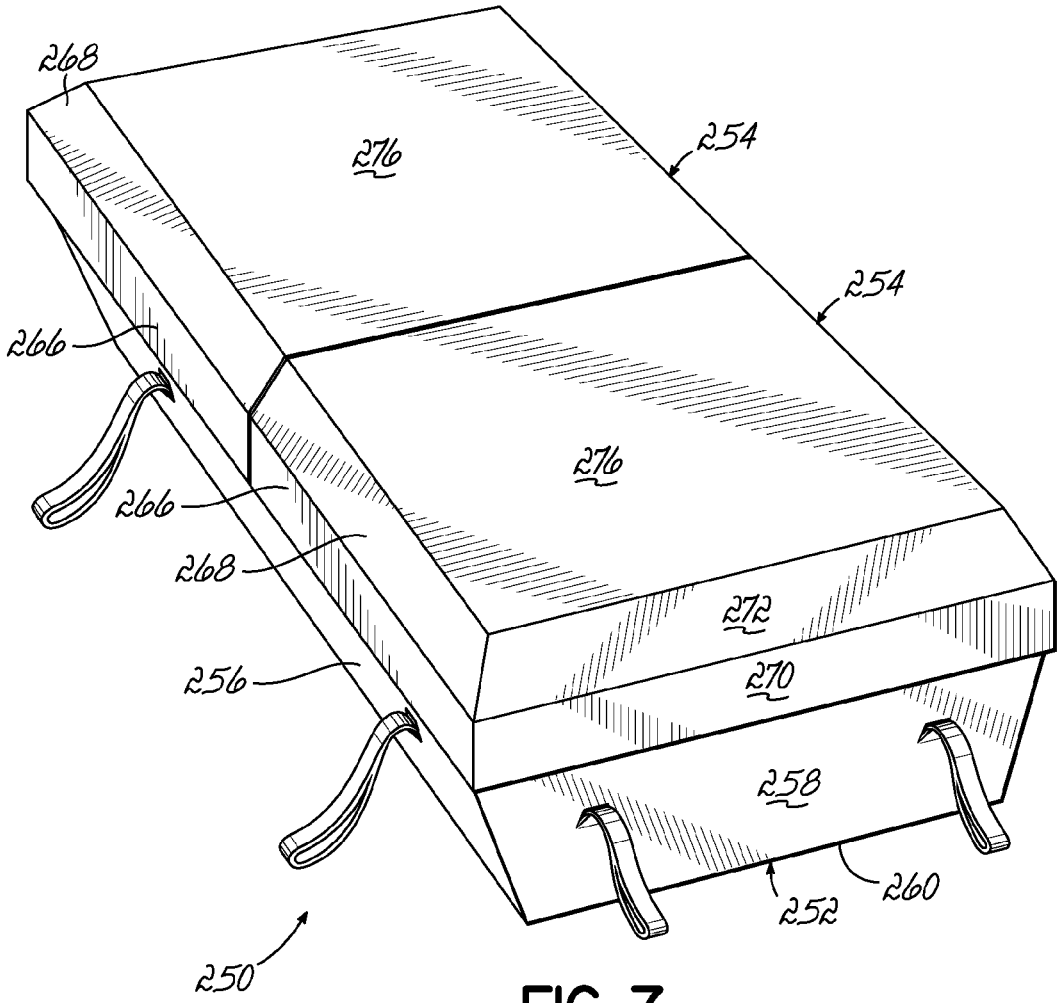
FIG. 7 is a perspective view of another embodiment of cardboard cremation container according to the principles of the present invention.
Figure 8A:
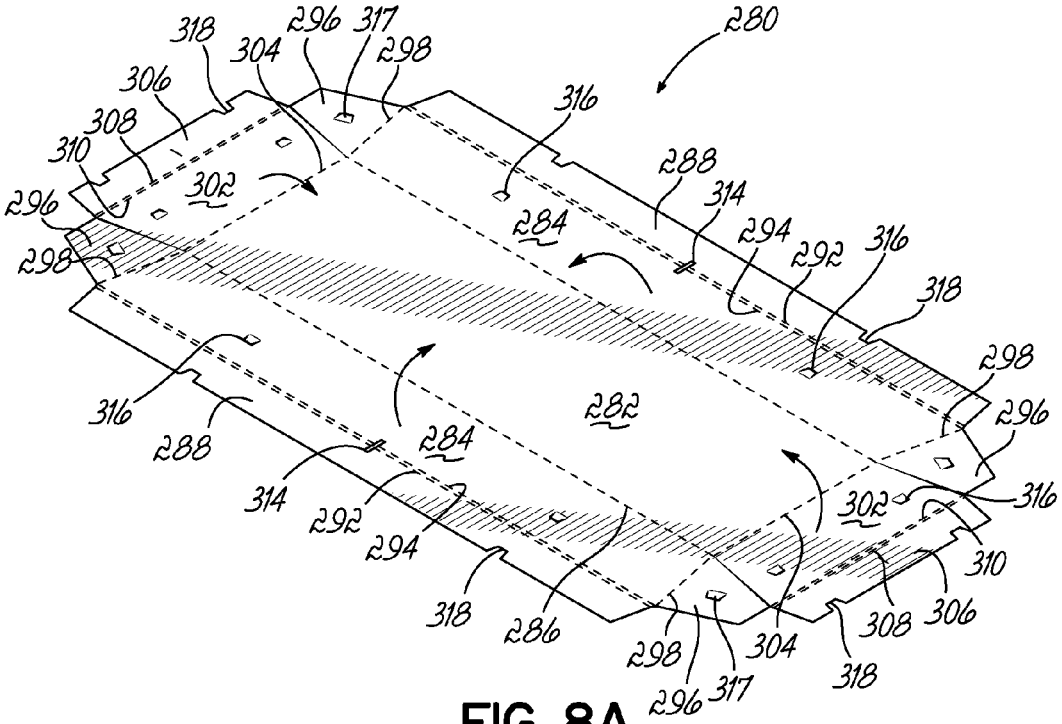
FIGS. 8A-8F illustrate steps in folding the base blank into the base of the container of FIG. 7.
Figure 8B:
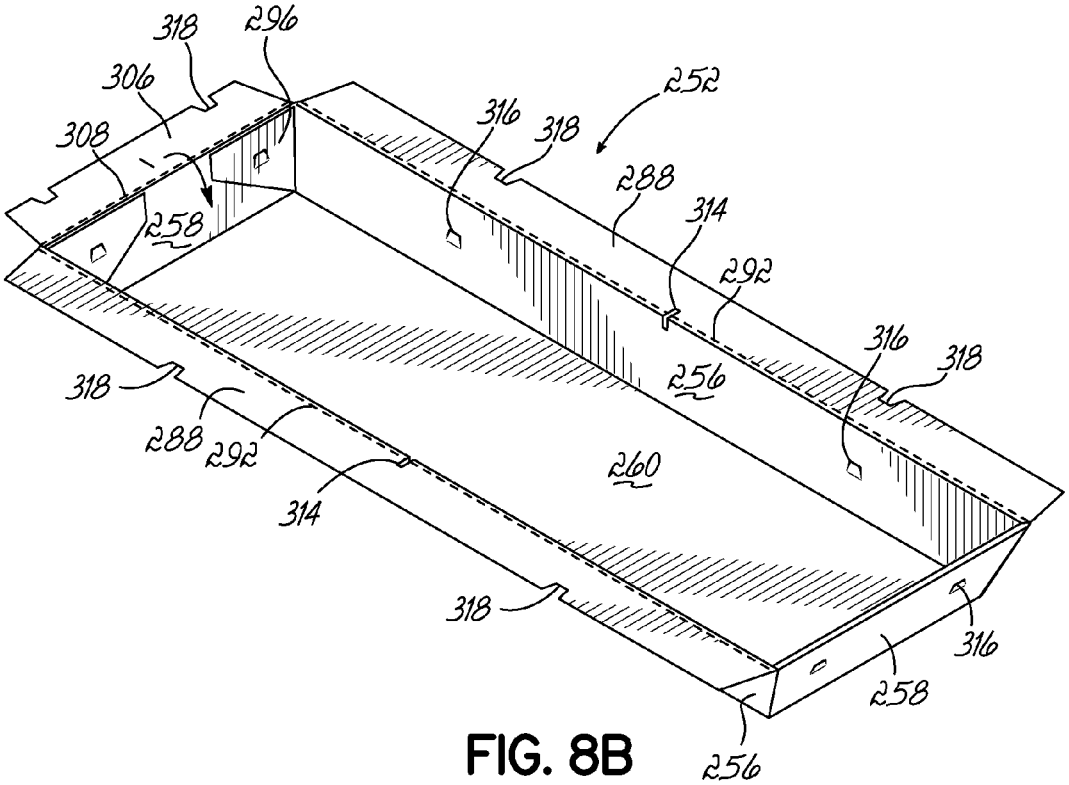
Figure 8C:
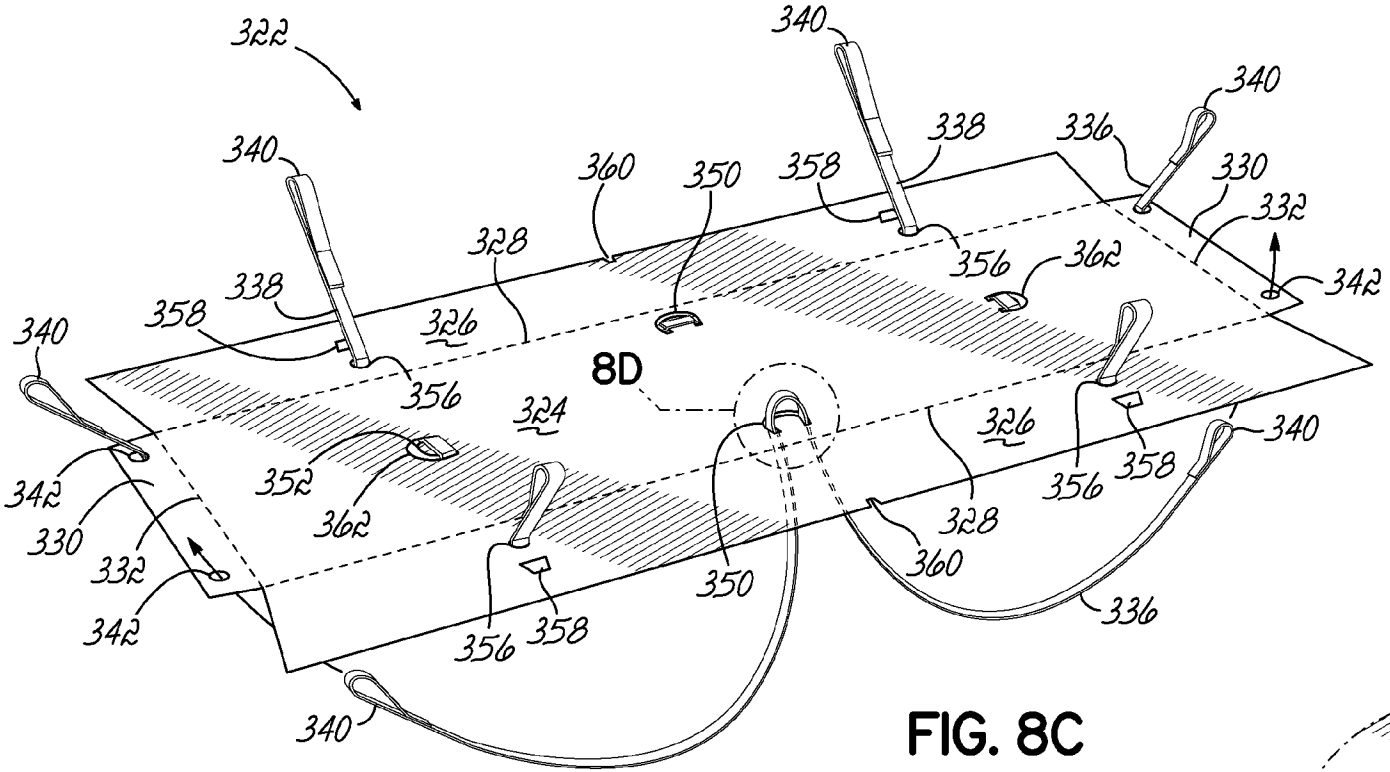
Figure 8D:
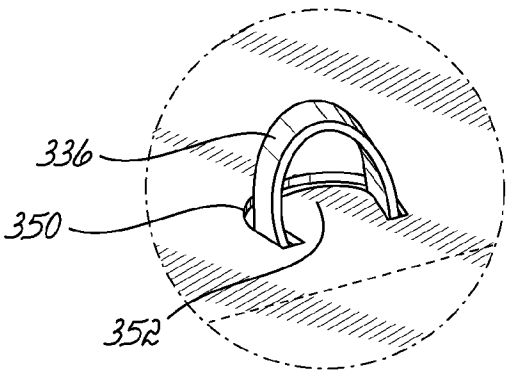
Figure 8E:
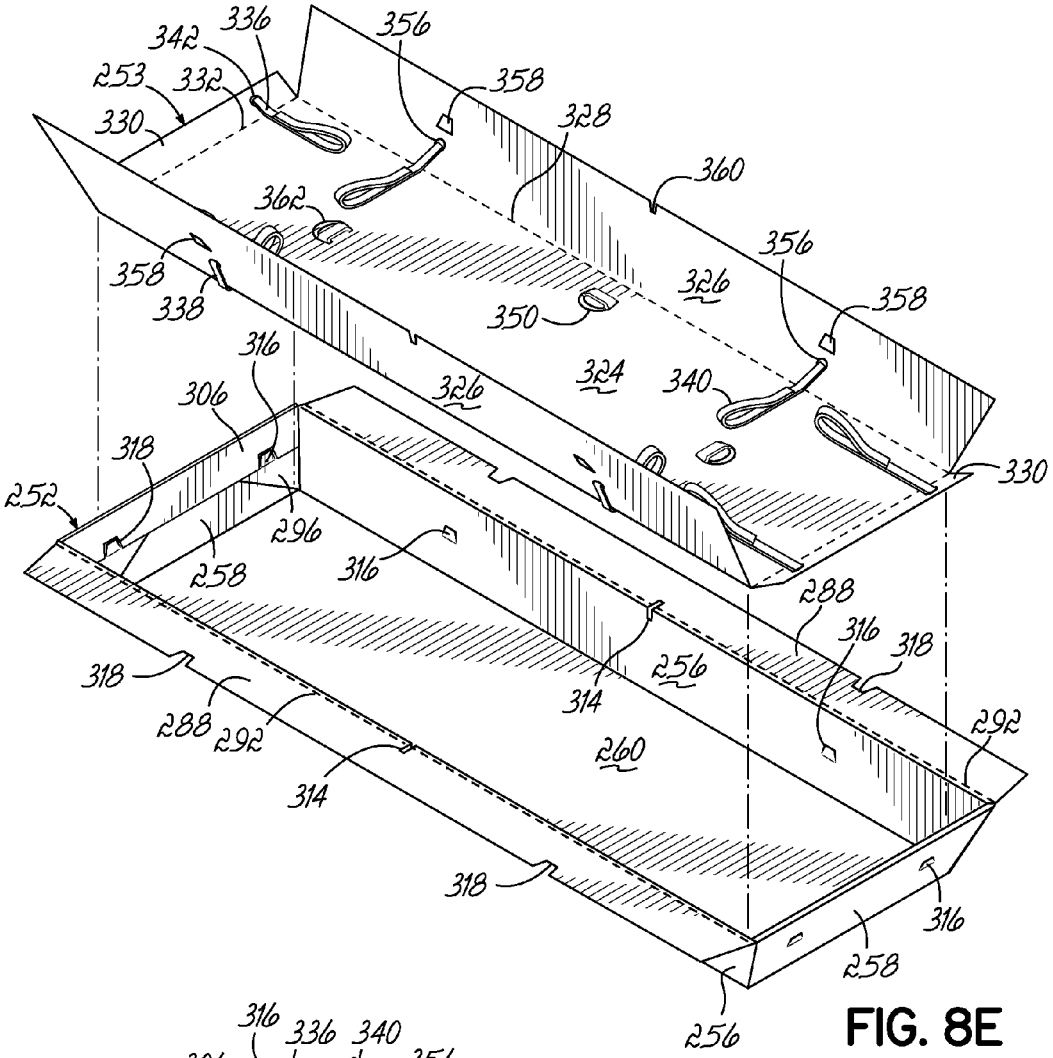
Figure 8F:
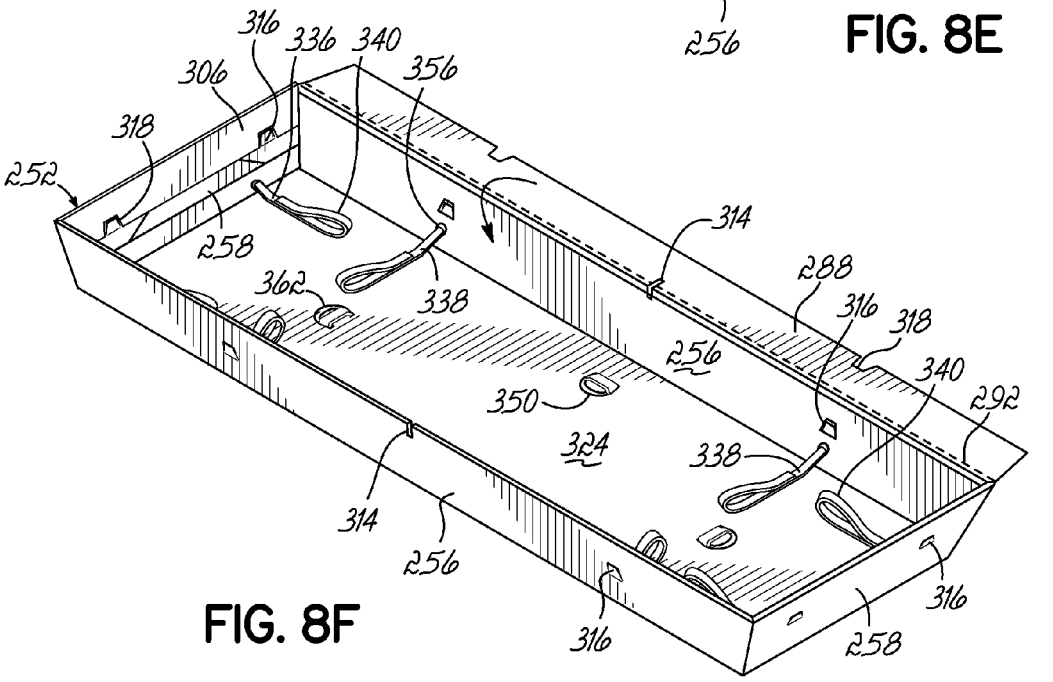
Figure 9A:
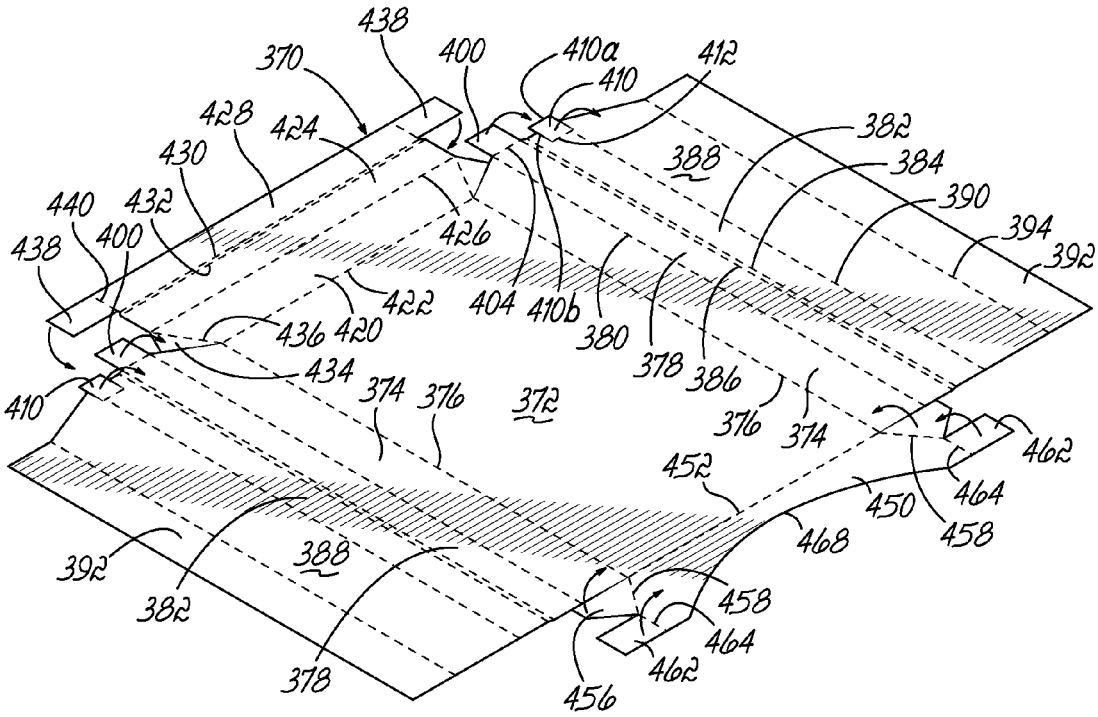
FIGS. 9A-9D illustrate steps in folding the lid blank into the lid of the container of FIG. 7.
Figure 9B:
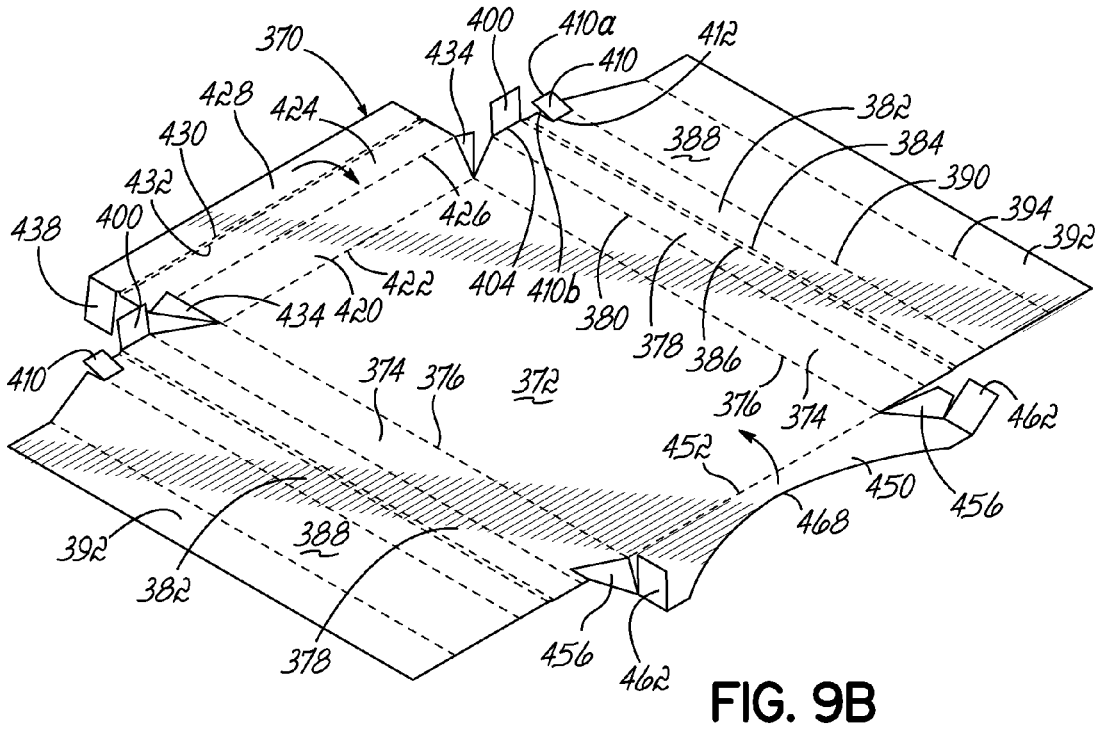
Figure 9C:
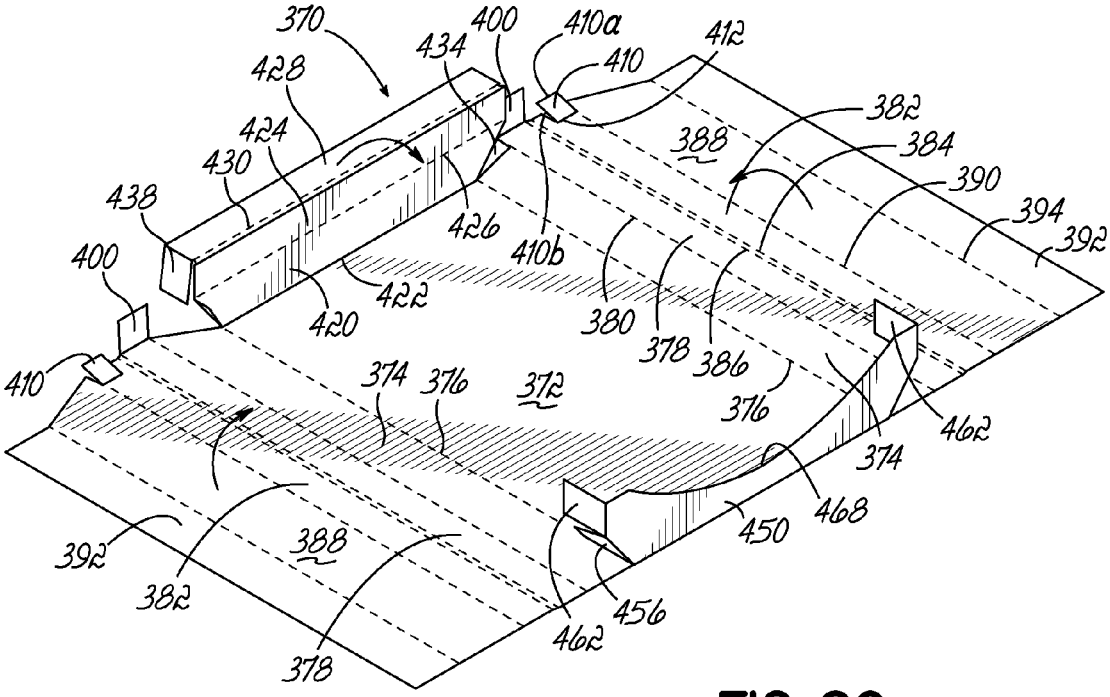
Figure 9D:
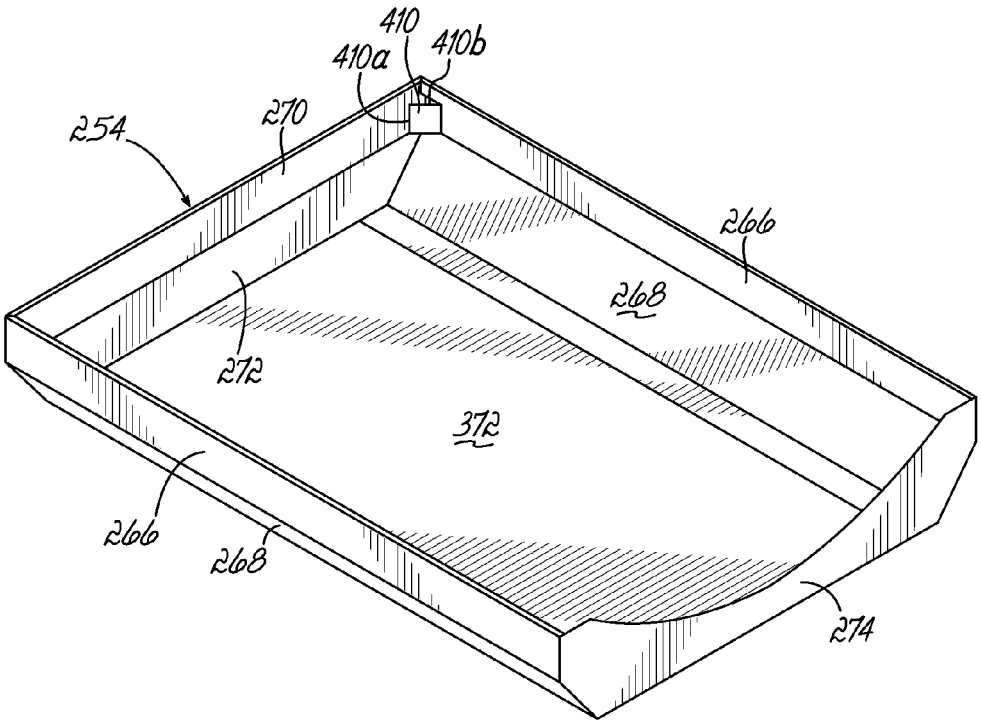

Referring to FIG. 7, another cardboard cremation container 250 according to the principles of the present invention is illustrated. The container 250 has a base 252 and a pair of identical lids 254, 254 closeable on the base 252. The base 252 has a pair of opposed side walls 256, 256, a pair of opposed end walls 258, 258, and a bottom wall 260. Each lid 254 has a pair of opposed side walls 266, 266, a pair of opposed side rim walls 268, 268, an end wall 270, an end rim wall 272, a header wall 274 (FIG. 9D), and a top wall 276.

Referring to FIGS. 8A-8F, a blank 280 from which to erect base 252 is illustrated. Blank 280 has a bottom wall panel 282, a side wall panel 284 foldably connected to each opposite side of the bottom wall panel 282 via a score line 286, and a side wall roll over panel 288 foldably connected to each side wall panel 284 via a pair of closely spaced score lines 292, 294. Closely spaced score lines 292, 294 form a roll over edge therebetween. A flap 296 is foldably connected to each opposite end of each side wall panel 284 via a score line 298. Blank 280 has an end wall panel 302 foldably connected to each opposite end of the bottom wall panel 282 via a score line 304, and an end wall roll over panel 306 foldably connected to each end wall panel 302 via a pair of closely spaced score lines 308, 310. Closely spaced score lines 308, 310 form a roll over edge therebetween. As in the prior embodiment, it will be seen that base blank 280 includes a notch 314 formed in each side wall panel 284, side wall roll over panel 288, and the roll over edge therebetween, for accepting the edges of two header walls of two lids, as in the previously discussed. Side wall panels 284 and end wall panels 302 of blank 280 include a plurality of handling strap cut-outs 316, each cut-out being generally trapezoidally shaped and having bottom score line and top and side cut lines. Cut-outs 316 are designed to blend into the base 252 and to reduce visibility into the container 250 during handling. Clearance holes 317 are provided in flaps 296 of outer base blank 280 so as to not interfere with handling strap cut-outs 316 in end wall panels 302. Clearance notches 318 are provided in the free edges of the side wall roll over panels 288 and end wall roll over panels 306 so as to not interfere with strap cut-outs 316.

An inner base 253 is erected from a blank 322. Blank 322 likewise has a bottom wall panel 324, a full height side wall panel 326 foldably connected to each opposite side of the bottom wall panel 324 via a score line 328, and a shorter end wall panel 330 foldably connected to each opposite end of the bottom wall panel 324 via a score line 332. A pair of longitudinal carrying straps 336, 336 and a pair of transverse carrying straps 338, 338 are provided. All the straps have a loop 340 formed on each end to assist grasping the strap. The straps can be fabricated of polypropylene, as one example. End wall panels 330 have strap holes 342. Bottom wall panel 324 has a pair of longitudinal horseshoe shaped cut-outs 350, 350 each having a tab or tongue 352. The central portion of each longitudinal strap 336 is looped above and over its respective tongue 352 in cut-outs 350 and its end loops 340 are passed through its respective holes 342 in the end wall panels 330 from the outside inwardly. Side wall panels 326 have lower strap holes 356 and upper strap holes 358. Bottom wall panel 324 has a pair of transverse horseshoe shaped cut-outs 362, 362 each having a tab or tongue 352. The central portion of each transverse strap 338 is looped above and over its respective tongue 352 in cut-outs 362 and its end loops 340 are passed through its respective lower holes 356 in the side wall panels 326 from the outside inwardly. As in the previous embodiment, a notch 360, complimentary to the notch 314 in outer base blank 280, is formed in the free edge of each side wall panel 326 of inner base blank 322 used to erect inner base 253, which cooperates with notch 314 to accept the abutting header walls of two lids.

To erect base 252 from blank 280, side wall panels 284 are folded upwardly and flaps 296 are folded inwardly. End wall panels 302 are folded upwardly. Flaps 296 are secured to end wall panels 302 with hot melt glue. End wall roll over panels 306 are folded inwardly and secured to flaps 296 and/or end wall panels 302 with hot melt glue. Inner base 253 is placed in outer base 252, and side wall roll over panels 288 are folded inwardly onto side wall panels 326 of inner base 253 and secured with hot melt glue. Loops 340 of longitudinal handling straps 336 are then passed outwardly through holes 316 in end wall panels 302 of inner base blank 280. Loops 340 of transverse handling straps 338 are passed outwardly through upper holes 358 in side wall panels 326 of inner base blank 322 and outwardly through cut-outs 316 in side wall panels 284 of outer base blank 280. Finally, the above described tray 120 may then be placed in base 252. As in the prior embodiment, the height of the side wall panels 284 and side wall roll over panels 288 and end wall panels 302 and end wall roll over panels 306 of base blank 280 and the height of the side wall panels 126 and end wall panels 130 of drip tray blank 122 are chosen such that the free edges of the side wall panels 126 and end wall panels 130 of drip tray blank 122 will securely "snap in" below the free edges of the side wall roll over panels 288 and end wall roll over panels 306 of base blank 280.

Referring to FIGS. 9A-9D, a blank 370 from which to erect lid 254 is illustrated. Blank 370 has a top wall panel 372, a side rim wall panel 374 foldably connected to each opposite side of the top wall panel 372 via a score line 376, a side wall panel 378 foldably connected to each side rim wall panel 374 via a score line 380, a side wall roll over panel 382 foldably connected to each side wall panel 378 via a pair of closely spaced score lines 384, 386 (forming a roll over edge therebetween), a side rim wall roll over panel 388 foldably connected to each side wall roll over panel 382 via a score line 390, and a top wall roll over panel 392 foldably connected to each side rim wall roll over panel 388 via a score line 394. A flap 400 is foldably connected to one end of each side wall panel 378 via a score line 404. A riser tab 410 is foldably connected to one end of each side wall roll over panel 382 via a score line 412. Each riser tab 410 has a first free edge 410*a* opposite its score line 412 and a second free edge 410*b* adjacent its score line 412. The riser tab score line 412 is positioned inward of an adjacent end of the side wall panel 378, the riser tab first free edge 410*a* is positioned outward of the adjacent end of the side wall panel 378, and the riser tab second free edge 410*b* is positioned outward of the score lines 384, 386 foldably connecting the side wall roll over panel 382 to the side wall panel 378. The riser tabs 410 function in much the same way as in the previous embodiment, extending across the corners of the lid 254 and resting on the corners of the base 252.

Blank 370 has an end rim wall panel 420 foldably connected to top wall panel 372 via a score line 422, and end wall panel 424 foldably connected to the end rim wall panel 420 via a score line 426, and an end wall roll over panel 428 foldably connected to the end wall panel 424 via a pair of closely spaced score lines 430, 432 (forming a roll over edge therebetween). A flap 434 is foldably connected to each opposite end of the end rim wall panel 420 via a score line 436. A flap 438 is foldably connected to each opposite end of the end wall roll over panel 428 via a score line 440.

Blank 370 also has a header wall panel 450 foldably connected to the opposite end of top wall panel 372 via a score line 452. Header wall panel 450 has a first inward flap 456 foldably connected to each opposite end of the header wall panel 450 via a score line 458, and a second outward flap 462 foldably connected to each opposite end of the header wall panel 450 via a score line 464. The free edge 468 of header wall panel 450 is preferably inwardly curved to accommodate larger bodies.

To assemble the lid 254 from the blank 370, the end rim wall panel 420, end wall panel 424, and end wall roll over panel 428, and header wall panel 450 are folded upwardly. Flaps 400, 434, 456, and 462 are folded inwardly, whereas flaps 438 are folded outwardly. Flaps 434 and 456 are secured to inner surfaces of side rim wall panels 374 with hot melt glue. Side wall panels 378 are folded further upwardly positioning tabs 400 adjacent an inner surface of end wall panel 424 and tabs 462 adjacent an inner surface of side wall panels 378. Next the end wall roll over panel 428 is folded inwardly against flaps 400 and end wall panel 424, placing flaps 438 adjacent inner surfaces of side wall panels 378. Finally, side wall roll over panels 382, side rim wall roll over panels 388, and top wall roll over panels 392 are folded inwardly against the side wall panel 378, the side rim wall panel 374, and the top wall panel 372, respectively. This causes risers 410 to "pop out" and extend across the corners of lid 254. The free edges of the top wall roll over panels 392 are secured to the top wall panel 372 with hot melt glue.

Figure 10:
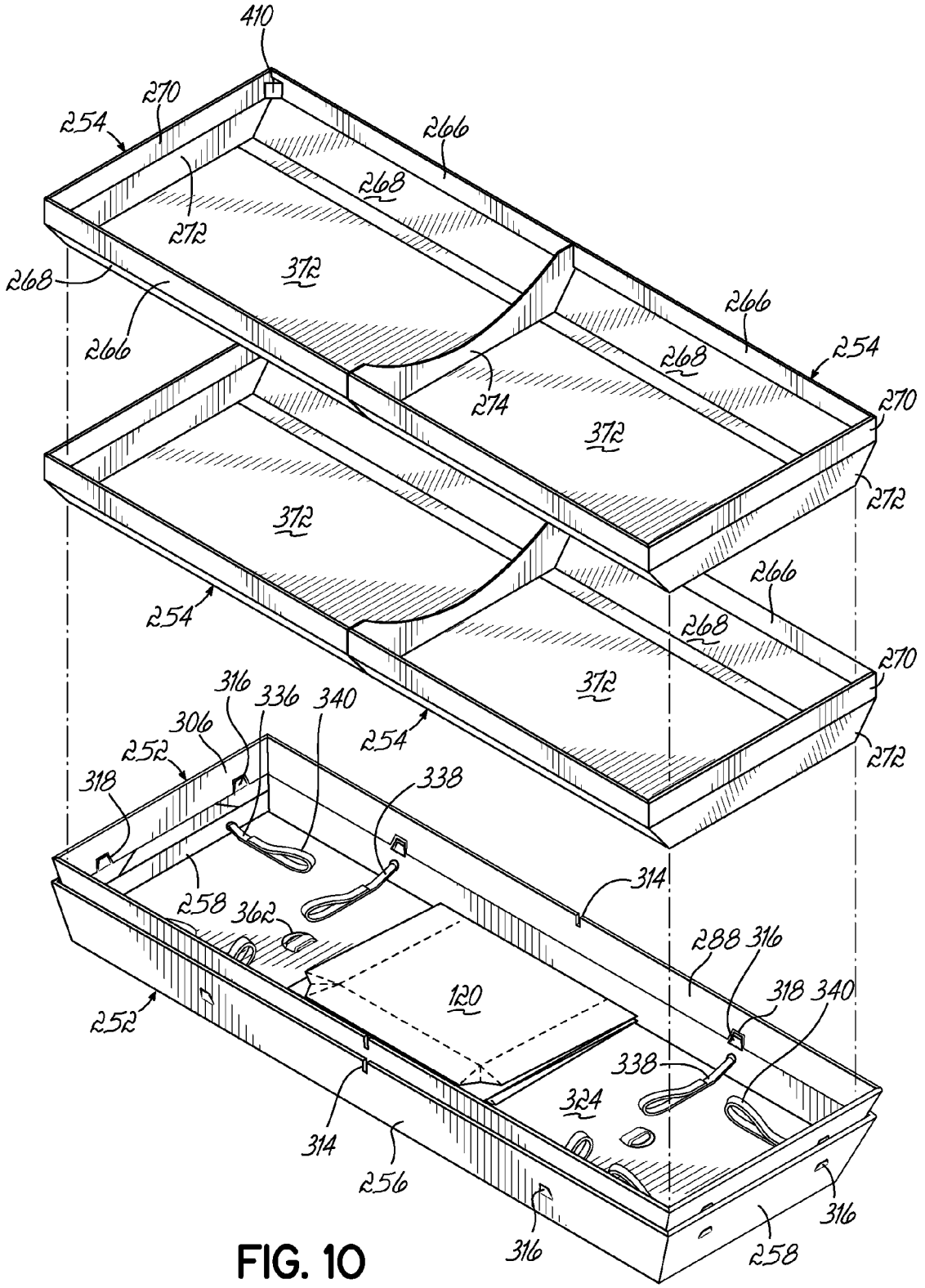
FIG. 10 illustrates a plurality of containers of FIG. 7 configured for shipping.

Referring to FIG. 10, a plurality of containers 250 are illustrated ready for shipment. The geometry of various ones of the panels, flaps, and score lines of the blank 280 described above is selected so as to provide side walls 256 and end walls 258 of base 252 which taper inwardly, by, for example, about 12 degrees, and to provide a depth of about 10.5 inches. This permits two bases 252 to be nested for shipment as illustrated, with the top base containing four fully erected lids 254, flipped upside down and nesting in one another as illustrated. As in the prior embodiment, each base 252 contains it own unerected (i.e. flat) drip tray 120 that is folded in half and then folded in half again. The entire contents can be shipped in the same standard cardboard shipping box described above and measuring about 82.5 inches long by about 29 inches wide by about 20.75 inches deep. At the shipping destination, nothing needs to be assembled; only tray 120 needs to be folded and placed into base 252.

Figure 11A:
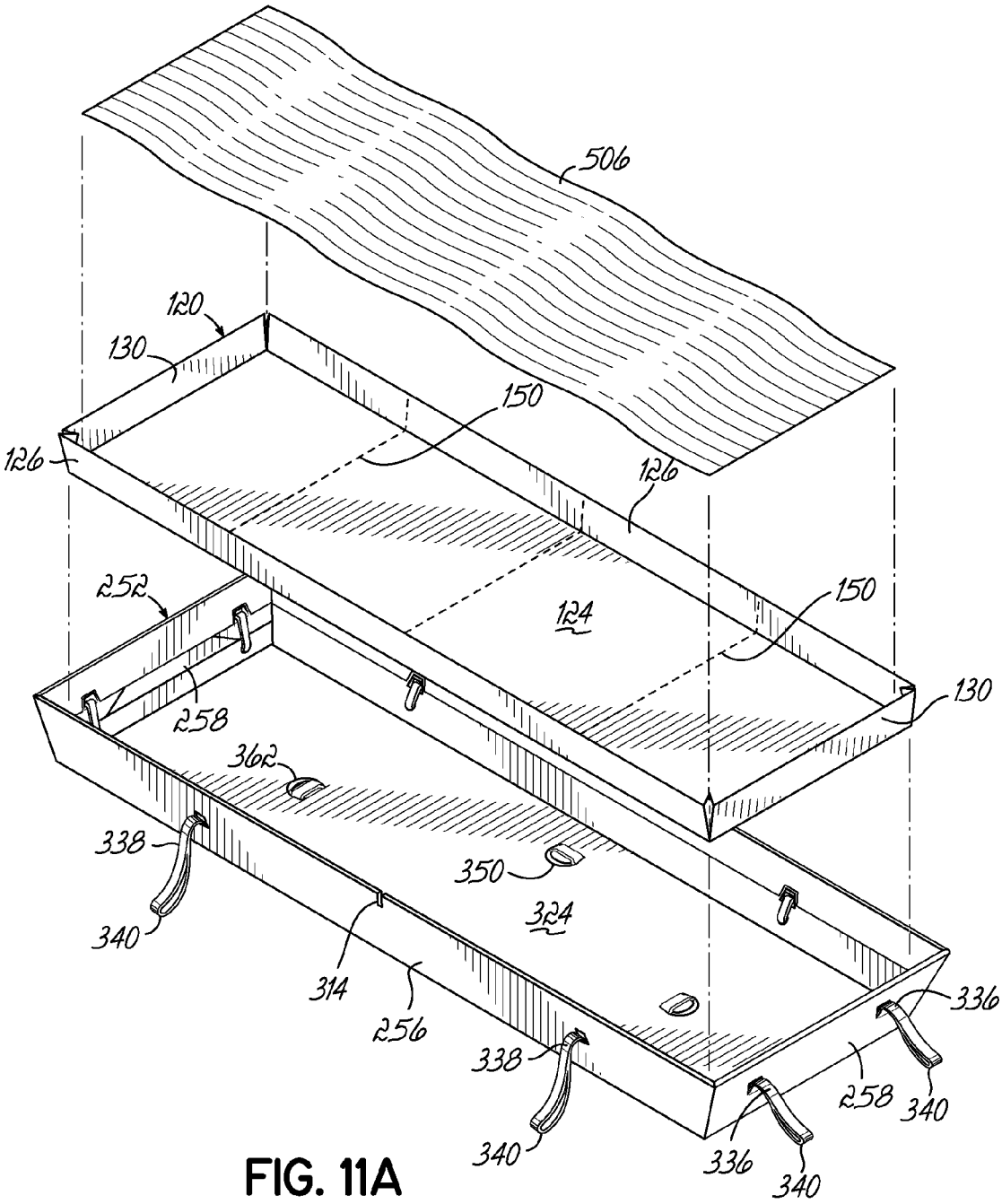
FIGS. 11A-11C illustrate steps in trimming the container of FIG. 7.
Figure 11B:
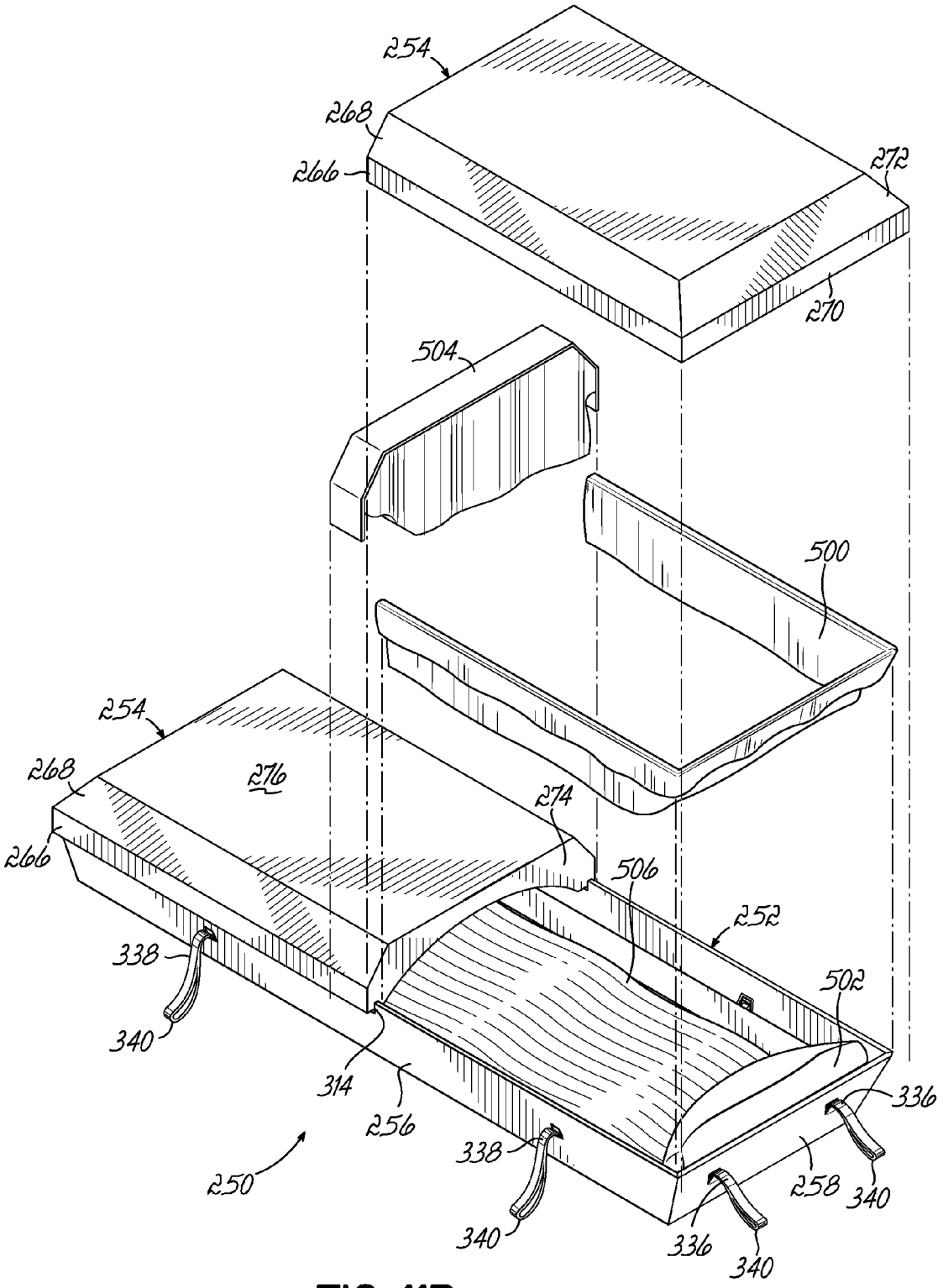
Figure 11C:
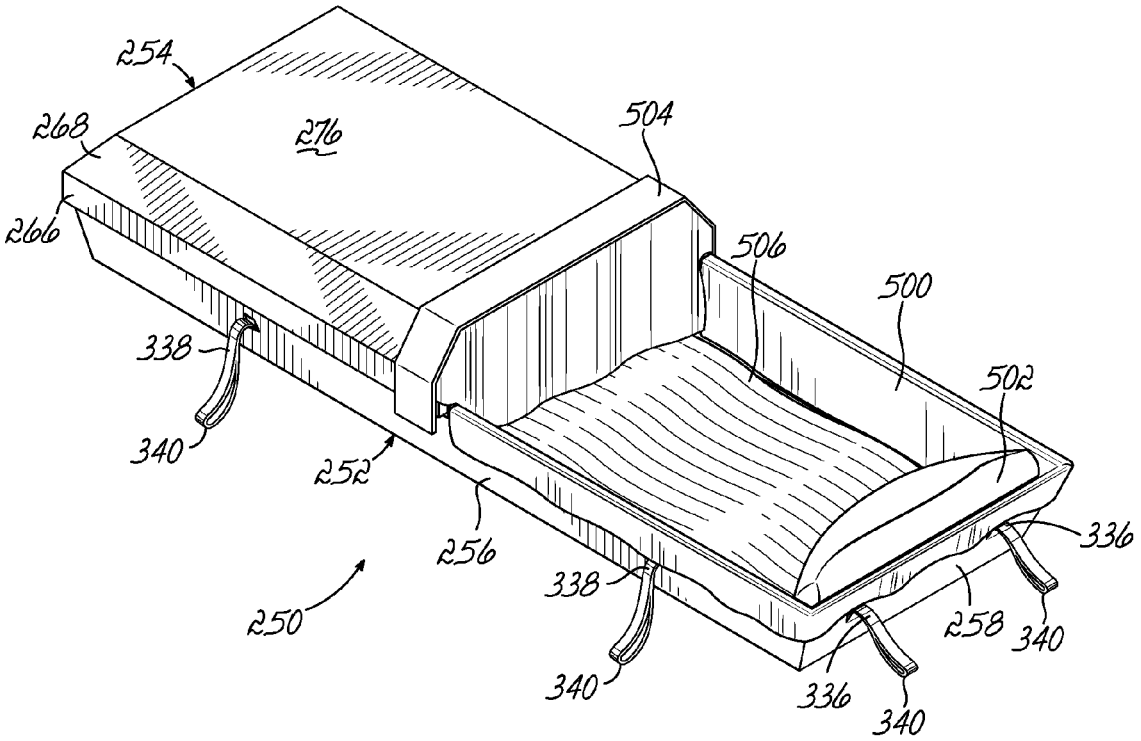

Referring to FIGS. 11A-11C, to trim the container 250 a big body 500, pillow 502, overthrow 504, and mattress 506 are provided. The big body 500 can be attached to the base with hook and loop fastener (not shown); the overthrow 504 simply lies across the head end of the foot end lid 254. Two sets of trim components can be placed in the top base 252 of the two nested bases 252 discussed above, for shipment.

The various embodiments of the invention shown and described are merely for illustrative purposes only, as the drawings and the description are not intended to restrict or limit in any way the scope of the claims. Those skilled in the art will appreciate various changes, modifications, and improvements which can be made to the invention without departing from the spirit or scope thereof. The invention in its broader aspects is therefore not limited to the specific details and representative apparatus and methods shown and described. Departures may therefore be made from such details without departing from the spirit or scope of the general inventive concept. Accordingly, the scope of the invention shall be limited only by the following claims and their equivalents.

What is claimed is:

1. A cardboard cremation container comprising:

a cardboard base having a pair of opposed side walls, a pair of opposed end walls, and a bottom wall, and a cardboard lid on said base, said lid having a pair of opposed side walls, an end wall, a header wall, and a top wall, each of said side walls of said base having a notch formed in an upper edge thereof, said side walls and said end wall of said lid extending outwardly beyond said side walls and one of said end walls of said base, lower edges of said side walls and said end wall of said lid positioned below upper edges of said side walls and said one end wall of said base, said header wall of said lid fitting in said notches in said side walls of said base, said lid including a riser at each corner of said lid formed by each said lid side wall and a respective end of said lid end wall, said risers supported on respective corners of said base formed by each said base side wall and a respective end of said one base end wall.

2. The container of claim 1 wherein said notches have a depth dimension, and lower edges of said risers are positioned above lower edges of said lid side walls and end wall by a height dimension, and wherein the depth dimension and the height dimension are approximately equal.

3. The container of claim 1 wherein said notches have a width dimension measured in a direction generally parallel to said side walls of said base, said width dimension being approximately equal to twice a thickness of said header wall of said lid.

4. The container of claim 1 wherein:

said notches have a depth dimension, and lower edges of said risers are positioned above lower edges of said lid side walls and end wall by a height dimension, and wherein the depth dimension and the height dimension are approximately equal, said notches have a width dimension measured in a direction generally parallel to said side walls of said base, said width dimension being approximately equal to twice a thickness of said header wall of said lid, and further comprising a second said lid, said side walls and said end wall of said second lid extending outwardly beyond said side walls and the other of said end walls of said base, lower edges of said side walls and said end wall of said second lid positioned below upper edges of said side walls and said other end wall of said base, said header walls of said lids fitting snugly in said notches in said side walls of said base, said risers of said second lid supported on respective corners of said base formed by each said base side wall and a respective end of said other of said base end walls.

5. The container of claim 1 wherein said side walls and said end wall of said lid are generally vertically oriented and are connected directly to said top wall of said lid, and wherein said side walls and said end walls of said base slope inwardly and downwardly from said upper edges of said side walls and said end walls to said bottom wall.

6. The container of claim 1 wherein said side walls and said end wall of said lid are generally vertically oriented and are connected indirectly to said top wall of said lid with planar lid portions that slope outwardly and downwardly from said top wall to said lid side walls and lid end wall, and wherein said side walls and said end walls of said base slope inwardly and downwardly from said upper edges of said side walls and said end walls to said bottom wall.

7. The container of claim 1 wherein said side walls and said end walls of said base include a plurality of hand hold cut-outs, each of said cut-outs defined by an upper horizontal score line, a lower horizontal cut line, and end semi-circular cut lines.

8. The container of claim 1 further comprising:

a pair of longitudinal carrying straps, and a pair of transverse carrying straps, each of said pair of longitudinal carrying straps having a loop on one end, passing through an opening in one of said end walls of said base, extending over said bottom wall of said base, passing through an opening in the other of said end walls of said base, and having a loop on the other end, each of said pair of transverse carrying straps having a loop on one end, passing through an opening in one of said side walls of said base, extending over said bottom wall of said base, passing through an opening in the other of said side walls of said base, and having a loop on the other end.

9. The container of claim 8 wherein said base is an outer base and further comprising:

an inner base having a pair of opposed side walls, a pair of opposed end walls, and a bottom wall, said inner base disposed in said outer base, each of said pair of longitudinal carrying straps passing through an opening in one of said end walls of said inner base, extending under said bottom wall of said inner base, and passing through an opening in the other of said end walls of said inner base, each of said pair of transverse carrying straps passing through an opening in one of said side walls of said inner base, extending under said bottom wall of said inner base, and passing through an opening in the other of said side walls of said inner base.

10. The container of claim 1 wherein said base is an outer base and further comprising:

an inner base having a pair of opposed side walls, a pair of opposed end walls, and a bottom wall, said inner base disposed in said outer base.

11. A cardboard cremation container comprising:

a cardboard base having a pair of opposed side walls, a pair of opposed end walls, and a bottom wall, and a cardboard lid on said base, said lid having a pair of opposed side walls, an end wall, a header wall, and a top wall, a pair of longitudinal carrying straps, and a pair of transverse carrying straps, each of said pair of longitudinal carrying straps having a loop on one end, passing through an opening in one of said end walls of said base, extending over said bottom wall of said base, passing through an opening in the other of said end walls of said base, and having a loop on the other end, each of said pair of transverse carrying straps having a loop on one end, passing through an opening in one of said side walls of said base, extending over said bottom wall of said base, passing through an opening in the other of said side walls of said base, and having a loop on the other end, wherein said base is an outer base and further comprising:

an inner base having a pair of opposed side walls, a pair of opposed end walls, and a bottom wall, said inner base disposed in said outer base, each of said pair of longitudinal carrying straps passing through an opening in one of said end walls of said inner base, extending under said bottom wall of said inner base, and passing through an opening in the other of said end walls of said inner base, each of said pair of transverse carrying straps passing through an opening in one of said side walls of said inner base, extending under said bottom wall of said inner base, and passing through an opening in the other of said side walls of said inner base.

12. A cardboard blank forming a cremation container lid comprising:

a top wall panel, a side wall panel foldably connected to each opposite side of said top wall panel, a side wall roll over panel foldably connected to each said side wall panel, a riser tab foldably connected to an end of each said side wall roll over panel, said riser tab having a transverse dimension that is less than a transverse dimension of said side wall roll over panel such that said riser tab extends across less than a full width of said side wall roll over panel, an end wall panel foldably connected to one end of said top wall panel, a flap foldably connected to each opposite end of said end wall panel, and a header wall panel foldably connected to the other end of said top wall panel, a flap foldably connected to each opposite end of said header wall panel, said riser tab positioned adjacent said end wall panel.

13. The blank of claim 12 wherein a free edge of said header wall panel is inwardly curved.

14. A cardboard blank forming a cremation container lid comprising:

a top wall panel, a side wall panel foldably connected to each opposite side of said top wall panel, a side wall roll over panel foldably connected to each said side wall panel, a riser tab foldably connected to an end of each said side wall roll over panel, an end wall panel foldably connected to one end of said top wall panel, a flap foldably connected to each opposite end of said end wall panel, and a header wall panel foldably connected to the other end of said top wall panel, a flap foldably connected to each opposite end of said header wall panel, wherein each said riser tab has a first free edge opposite a fold line foldably connecting said riser tab to a respective said side wall roll over panel, said riser tab fold line positioned inward of an adjacent end of said side wall panel, said riser tab first free edge positioned outward of said adjacent end of said side wall.

15. The blank of claim 14 wherein each said riser tab has a second free edge adjacent said fold line foldably connecting said riser tab to a respective said side wall roll over panel, said riser tab second free edge positioned outward of a fold line foldably connecting said side wall roll over panel to said side wall panel.

16. A cardboard cremation container lid comprising:

a top wall panel, a side wall panel foldably connected to each opposite side of said top wall panel, a side wall roll over panel foldably connected to each said side wall panel, a riser tab foldably connected to an end of each said side wall roll over panel, an end wall panel foldably connected to one end of said top wall panel, a flap foldably connected to each opposite end of said end wall panel, and a header wall panel foldably connected to the other end of said top wall panel, a flap foldably connected to each opposite end of said header wall panel, said side wall panels, said end wall panel, and said header wall panel folded relative to said top wall panel to form a pair of opposed side walls, an end wall, a header wall, and a top wall of said lid, with said flaps on said end wall panel and on said header wall panel folded so as to be positioned inward of said side wall panels, said side wall roll over panels folded relative to said side wall panels so as to be positioned inward of said side wall panels and said flaps, and said riser tabs folded so as to angle across a respective corner of said lid formed by each said lid side wall and a respective end of said lid end wall.

17. The lid of claim 16 wherein lower edges of said risers are positioned above lower edges of said lid side walls and end wall.

18. The lid of claim 16 wherein a free edge of said header wall is upwardly curved.

19. A cardboard blank forming a cremation container lid comprising:

a top wall panel, a side rim wall panel foldably connected to each opposite side of said top wall panel, a side wall panel foldably connected to each said side rim wall panel, a side wall roll over panel foldably connected to each said side wall panel, a riser tab foldably connected to an end of each said side wall roll over panel, an end rim wall panel foldably connected to one end of said top wall panel, an end wall panel foldably connected to said end rim wall panel, an end wall roll over panel foldably connected to said end wall panel, a flap foldably connected to each opposite end of said end wall roll over panel, and a header wall panel foldably connected to the other end of said top wall panel, a flap foldably connected to each opposite end of said header wall panel, said riser tab having a transverse dimension that is less than a transverse dimension of said side wall roll over panel such that said riser tab extends across less than a full width of said side wall roll over panel, said riser tab positioned adjacent said end wall panel.

20. The blank of claim 19 wherein each said riser tab has a first free edge opposite a fold line foldably connecting said riser tab to a respective said side wall roll over panel, said riser tab fold line positioned inward of an adjacent end of said side wall panel, said riser tab first free edge positioned outward of said adjacent end of said side wall panel.

21. The blank of claim 20 wherein each said riser tab has a second free edge adjacent said fold line foldably connecting said riser tab to a respective said side wall roll over panel, said riser tab second free edge positioned outward of a fold line foldably connecting said side wall roll over panel to said side wall panel.

22. The blank of claim 19 wherein a free edge of said header wall panel is inwardly curved.

23. A cardboard cremation container lid comprising:

a top wall panel, a side rim wall panel foldably connected to each opposite side of said top wall panel, a side wall panel foldably connected to each said side rim wall panel, a side wall roll over panel foldably connected to each said side wall panel, a riser tab foldably connected to an end of each said side wall roll over panel, an end rim wall panel foldably connected to one end of said top wall panel, an end wall panel foldably connected to said end rim wall panel, an end wall roll over panel foldably connected to said end wall panel, a flap foldably connected to each opposite end of said end wall roll over panel, and a header wall panel foldably connected to the other end of said top wall panel, a flap foldably connected to each opposite end of said header wall panel, said side rim wall panels, side wall panels, end rim wall panel, end wall panel, and header wall panel folded relative to said top wall panel to form a pair of opposed side rim walls, a pair of opposed side walls, an end rim wall, an end wall, a header wall, and a top wall of said lid, with said flaps on said end wall roll over panel and on said header wall panel folded so as to be positioned inward of said side wall panels, said side wall roll over panels folded relative to said side wall panels so as to be positioned inward of said side wall panels and said flaps, and said riser tabs folded so as to angle across a respective corner of said lid formed by each said lid side wall and a respective end of said lid end wall.

24. The lid of claim 23 wherein lower edges of said risers are positioned above lower edges of said lid side walls and end wall.

25. The lid of claim 23 wherein a free edge of said header wall is upwardly curved.

26. A cardboard cremation container base comprising:

cardboard outer base comprising:

a bottom wall panel, a side wall panel foldably connected to each opposite side of said bottom wall panel, a flap foldably connected to each opposite end of each said side wall panel, a side wall roll over panel foldably connected to each said side wall panel, an end wall panel foldably connected to each opposite end of said bottom wall panel, and an end wall roll over panel foldably connected to each said end wall panel, a cardboard inner base comprising:

a bottom wall panel, a side wall panel foldably connected to each opposite side of said bottom wall panel, and an end wall panel foldably connected to each opposite end of said bottom wall panel, said side wall panels and end wall panels of said outer base folded relative to said bottom wall panel of said outer base to form a pair of opposed outer side walls, a pair of opposed outer end walls, and an outer bottom wall of said outer base, with said flaps on said side wall panels of said outer base folded so as to be positioned inward of said end wall panels of said outer base, said end wall roll over panels of said outer base folded relative to said end wall panels so as to be positioned inward of said end wall panels and said flaps, said side wall panels and end wall panels of said inner base folded relative to said bottom wall panel of said inner base to form a pair of opposed inner side walls, a pair of opposed inner end walls, and an inner bottom wall of said inner base, said inner base placed into said outer base, and said side wall roll over panels of said outer base folded relative to said side wall panels of said outer base so as to be positioned inward of said side walls of said inner base.

27. The base of claim 26 wherein the height of said side wall panels of said inner base is about equal to the height of said side wall panels of said outer base, the height of said side wall roll over panels of said outer base is less than the height of said side wall panels of said outer base, and the height of said end wall roll over panels of said outer base is less than the height of said end wall panels of said outer base.

28. The base of claim 27 wherein the height of said side wall roll over panels of said outer base is about equal to the height of said end wall roll over panels of said outer base.

29. The base of claim 27 wherein said outer side walls and said outer end walls of said outer base slope inwardly and downwardly from upper edges of said outer side walls and said outer end walls to said outer bottom wall.

* * * * *